US009193155B2

(12) United States Patent
Kyoso

(10) Patent No.: US 9,193,155 B2
(45) Date of Patent: Nov. 24, 2015

(54) IMAGE FORMING APPARATUS

(71) Applicant: FUJIFILM Corporation, Tokyo (JP)

(72) Inventor: Tadashi Kyoso, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/551,556

(22) Filed: Nov. 24, 2014

(65) Prior Publication Data

US 2015/0151535 A1 Jun. 4, 2015

(30) Foreign Application Priority Data

Dec. 2, 2013 (JP) ..... 2013-249498

(51) Int. Cl.

| | |
|---|---|
| ***B41J 29/38*** | (2006.01) |
| ***B41J 2/045*** | (2006.01) |
| ***B41J 2/21*** | (2006.01) |
| ***B41J 25/00*** | (2006.01) |

(52) U.S. Cl.

CPC ..... *B41J 2/04501* (2013.01); *B41J 2/04525* (2013.01); *B41J 2/2146* (2013.01); *B41J 25/001* (2013.01)

(58) Field of Classification Search

CPC ..... B41J 2/2146; B41J 2/04525

See application file for complete search history.

(56) References Cited

U.S. PATENT DOCUMENTS

| | | | | |
|---|---|---|---|---|
| 6,390,583 | B1 | 5/2002 | Kato et al. | |
| 2009/0244177 | A1* | 10/2009 | Tatsumi | 347/37 |
| 2010/0277540 | A1* | 11/2010 | Snyder et al. | 347/19 |

FOREIGN PATENT DOCUMENTS

| | | | |
|---|---|---|---|
| JP | 2008-132658 | A | 6/2008 |
| JP | 2008-143023 | A | 6/2008 |
| JP | 2011-152710 | A | 8/2011 |

OTHER PUBLICATIONS

The extended European search report issued by the European Patent Office on Apr. 17, 2015, which corresponds to European Patent Application No. 14194912.3—1701 and is related to U.S. Appl. No. 14/551,556.

* cited by examiner

*Primary Examiner* — Shelby Fidler
(74) *Attorney, Agent, or Firm* — Studebaker & Brackett PC

(57) ABSTRACT

An image forming apparatus that forms an image where occurrence of concentration unevenness caused by occurrence of mechanical crosstalk is suppressed are provided. According to the present invention, the distance from the boundary position of the inkjet head corresponding to the concentration boundary between the first concentration region and the second concentration region to the second concentration region end of the inkjet head is less than the reciprocal of the spatial frequency of the concentration unevenness. Accordingly, the length of the part in the first direction where the inkjet head forms the second concentration region is less than one period of the concentration unevenness. Even if crosstalk due to vibrations of the part where the inkjet head forms the first concentration region occurs, the visibility of the concentration unevenness occurring in the second concentration region can be reduced.

8 Claims, 24 Drawing Sheets

IMAGE FORMING APPARATUS

CROSS-REFERENCE TO RELATED APPLICATIONS

The patent application claims priority under 35 U.S.C. §119 to Japanese Patent Application No. 2013-249498, filed on Dec. 2, 2013. Each of the above application(s) is hereby expressly incorporated by reference, in its entirety, into the present application.

BACKGROUND OF THE INVENTION

1. Field of the Invention

The present invention relates to an image forming apparatus and, in particular, to an image forming technique for reducing visibility of concentration unevenness on an image which is generated by crosstalk of an inkjet head.

2. Description of the Related Art

As a general-purpose image forming apparatus, an inkjet recording apparatus for ejecting ink from multiple nozzles provided in an inkjet head and forming an image on paper (recording medium) has been known. The inkjet recording apparatus causes piezoelectric elements corresponding to the respective nozzles on the basis of image data to operate to eject ink from the nozzles.

Higher density arrangement of nozzles in conformity with a demand for improving the quality of an image to be formed, in turn, arranges the piezoelectric elements corresponding to the respective nozzles at high density. As a result, the operation of any piezoelectric element causes crosstalk that affects the ejection efficiency (ejection performance) of nozzles arranged adjacent thereto.

Occurrence of concentration unevenness on an image caused by occurrence of crosstalk degrades the image quality. In order to achieve image forming at high quality, occurrence of crosstalk is required to be suppressed to, in turn, suppress variation in ejection efficiency of each nozzle.

Crosstalk at the inkjet head is roughly classified into mechanical crosstalk and acoustic wave crosstalk. The mechanical crosstalk is a phenomenon where propagation of vibrations in an operation of a piezoelectric element to another piezoelectric element varies the operation state of the other piezoelectric element (e.g., the amount of variation of piezoelectric element) and, as a result, the ejection efficiency (ejection performance) varies.

The acoustic wave crosstalk is a phenomenon where transmission of acoustic waves in ink propagates to another nozzle, and varies the ejection efficiency (ejection performance) of the other nozzle.

Japanese Patent Application Laid-Open No. 2008-143023 describes an inkjet recording apparatus (inkjet printer) including an inkjet head (inkjet recording head) in which multiple nozzles are arranged in a matrix.

The inkjet recording apparatus described in this document includes an air damper provided in a manifold in an inkjet head such that vibrations due to ink ejection do not affect another nozzle (for preventing crosstalk).

SUMMARY OF THE INVENTION

Although the inkjet head described in Japanese Patent Application Laid-Open No. 2008-143023 can suppress acoustic wave crosstalk, it is difficult to suppress mechanical crosstalk of the inkjet head using the configuration where the air damper is provided in the manifold in the inkjet head.

The present invention is made in view of such situations, and has an object to provide an image forming apparatus and an image forming method that form an image where occurrence of concentration unevenness caused by occurrence of mechanical crosstalk is suppressed.

In order to achieve the above object, an image forming apparatus is provided which includes: an inkjet head which includes a plurality of nozzles arranged in a first direction; a concentration unevenness information acquisition device which, when forming an image including a first concentration region, and a second concentration region having a relatively lower concentration than the first concentration region has using the inkjet head, acquires concentration unevenness information on whether concentration unevenness is visible in a concentration boundary region in the second concentration region or not; and an adjustment device which, when the concentration unevenness information acquisition device acquires the concentration unevenness information representing that the concentration unevenness is visible, adjusts relative positions between the inkjet head and the image formed by the inkjet head to make a distance from a boundary position of the inkjet head in the first direction corresponding to a position of the concentration boundary in the first direction to a second concentration region end of the inkjet head in the first direction be less than a reciprocal of a spatial frequency of the concentration unevenness.

According to the present invention, the distance from the boundary position of the inkjet head corresponding to the concentration boundary between the first concentration region and the second concentration region to the second concentration region end of the inkjet head is less than the reciprocal of the spatial frequency of the concentration unevenness. Accordingly, the length of the part in the first direction where the inkjet head forms the second concentration region is less than one period of the concentration unevenness. Even if crosstalk due to vibrations of the part where the inkjet head forms the first concentration region occurs, the visibility of the concentration unevenness occurring in the second concentration region can be reduced.

BRIEF DESCRIPTION OF THE PREFERRED EMBODIMENT

DETAILED DESCRIPTION OF THE PREFERRED EMBODIMENTS

Referring to the accompanying drawings, preferred embodiments of the present invention are hereinafter described in detail.

[Overall Configuration of Inkjet Recording Apparatus]

Figure 1:
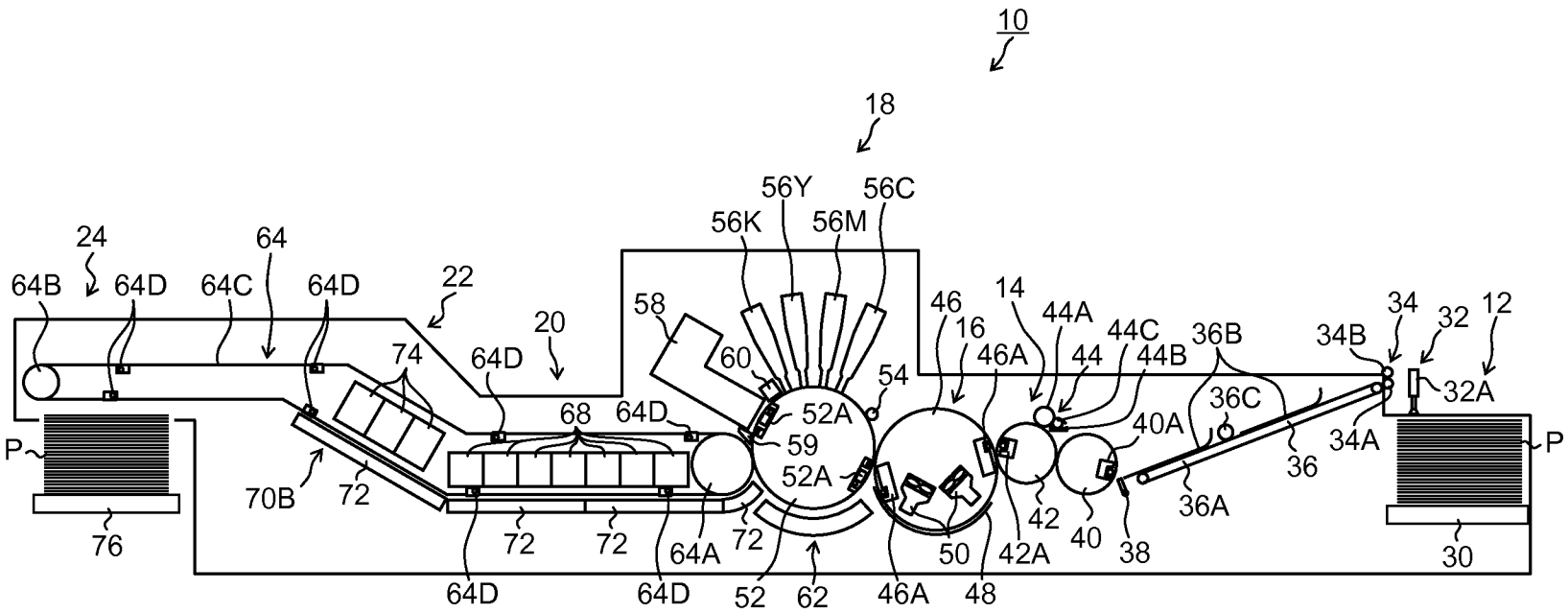
FIG. 1 is an overall configuration diagram of an inkjet recording apparatus according to an embodiment of the present invention.

FIG. 1 is an overall configuration diagram of an image forming apparatus (inkjet recording apparatus) according to an embodiment of the present invention.

The inkjet recording apparatus 10 shown in this diagram is an inkjet recording apparatus for recording an image according to inkjetting through use of aqueous UV ink (UV (ultraviolet) cure ink containing aqueous solvent) onto a sheet of paper P. The inkjet recording apparatus 10 mainly includes: a paper supply device 12 which supplies the paper P; a process liquid applying device 14 which applies process liquid to a surface of the paper P supplied from the paper supply device 12; a process liquid drying device 16 which performs a process of drying the paper P to which the process liquid has been applied by the process liquid applying device 14; an image forming device 18 which records an image according to inkjetting through use of the aqueous UV ink onto the surface of the paper P to which the drying process has been applied by the process liquid drying device 16; an ink drying device 20 which performs a process of drying the paper P on which the image has been recorded by the image forming device 18; a UV irradiation device 22 which fixes the image by irradiating, with UV light (activation light), the paper P to which the drying process has been applied by the ink drying device 20; and a paper ejection device 24 which ejects the paper P to which the UV irradiation process has been applied by the UV irradiation device 22.

<Paper Supply Device>

The paper supply device 12 mainly includes: a paper supply table 30; a sucker 32; a paper supply roller pair 34; a feeder board 36; a front regulator 38; and a paper supply drum 40. Sheets of paper P stacked on the paper supply table 30 are supplied one by one to the process liquid applying device 14.

The sheets of paper P stacked on the paper supply table 30 are raised from the top on a sheet-by-sheet basis by the sucker 32 (suction fit 32A) and supplied to the paper supply roller pair 34 (between the pair of upper and lower rollers 34A and 34B).

The paper P supplied to the paper supply roller pair 34 is fed forward by the pair of upper and lower rollers 34A and 34B, and stacked on the feeder board 36. The paper P stacked on the feeder board 36 is conveyed by a tape feeder 36A provided on a conveyance surface of the feeder board 36.

The sheet is pressed against the conveyance surface of the feeder board 36 by a retainer 36B and a guide roller 36C during a conveyance process, thereby correcting unevenness. The front end of the paper P conveyed by the feeder board 36 comes into contact with the front regulator 38, thereby correcting the inclination. The paper is then passed to the paper supply drum 40. The paper is gripped at the front end by a gripper 40A of the paper supply drum 40 and conveyed to the process liquid applying device 14.

<Process Liquid Applying Device>

The process liquid applying device 14 mainly includes: a process liquid applying drum 42 which conveys the paper P; and a process liquid applying unit 44 which applies prescribed process liquid to a surface of the paper P conveyed by the process liquid applying drum 42. This device applies the process liquid to the surface of the paper P.

As to the process liquid applied to the surface of the paper P, the process liquid has a function of aggregating coloring materials in aqueous UV ink which is to be deposited on the paper P by the image forming device 18 at a later stage. The application of the process liquid to the surface of the paper P and deposition of the aqueous UV ink can achieve high quality printing without causing deposition interference and the like even through use of general printing paper.

The paper P passed from the paper supply drum 40 of the paper supply device 12 is then passed to the process liquid applying drum 42. The process liquid applying drum 42 causes a gripper 42A to grip (take) the front end of the paper P and rotates, thereby rolling the paper P on the periphery and conveying the paper.

In this conveyance process, an application roller 44A, to which a constant amount of process liquid measured by a measuring roller 44C from a process liquid pan 44B has been applied, is pressed against the surface of the paper P, thereby applying the process liquid to the surface of the paper P. The mode of applying the process liquid is not limited to roller application. Alternatively, another mode, such as inkjetting or application using a blade, may be adopted.

<Process Liquid Drying Device>

The process liquid drying device 16 mainly includes: a process liquid drying drum 46 which conveys the paper P; a paper conveyance guide 48 which supports (guides) the underside of the paper P; and a process liquid drying unit 50 which blows a hot wind to the surface of the paper P conveyed by the process liquid drying drum 46 to dry the paper. This device applies a drying process to the paper P having the surface to which the process liquid has been applied.

The front end of the paper P passed from the process liquid applying drum 42 of the process liquid applying device 14 to the process liquid drying drum 46 is gripped by a gripper 46A included in the process liquid drying drum 46.

The underside of the paper P is supported by the paper conveyance guide 48 in a state where the surface (the surface to which the process liquid is applied) of the paper P faces inward. In this state, the process liquid drying drum 46 is rotated to convey the paper P.

In the process of conveyance by the process liquid drying drum 46, hot wind is blown from the process liquid drying unit 50 provided in the process liquid drying drum 46 to the surface of the paper P to apply the drying process to the paper P, thereby removing a solvent component in the process liquid and forming an ink aggregation layer on the surface of the paper P.

<Image Forming Device>

The image forming device 18 mainly includes: an image formation drum 52 which conveys the paper P; a paper pressing roller 54 which presses the paper P conveyed by the image formation drum 52 to cause the paper P to come into contact with the periphery of the image formation drum 52; head units 56C, 56M, 56Y and 56K which eject ink droplets having respective colors C, M, Y and K on the paper P; an in-line sensor 58 which reads the image recorded on the paper P; a mist filter 60 which captures ink mist; and a drum cooling unit 62. This device deposits droplets of ink having C, M, Y and K colors on the surface of the paper P on which the process liquid layer has been formed, thereby painting a color image on the surface of the paper P.

Various ejection schemes are applicable to the inkjet head adopted in this example. The schemes may be the piezoelectric scheme which utilizes deformation of a piezoelectric element to eject ink (see FIG. 6), and a thermal scheme which heats ink to cause a film boiling phenomenon and eject ink.

Figure 3:
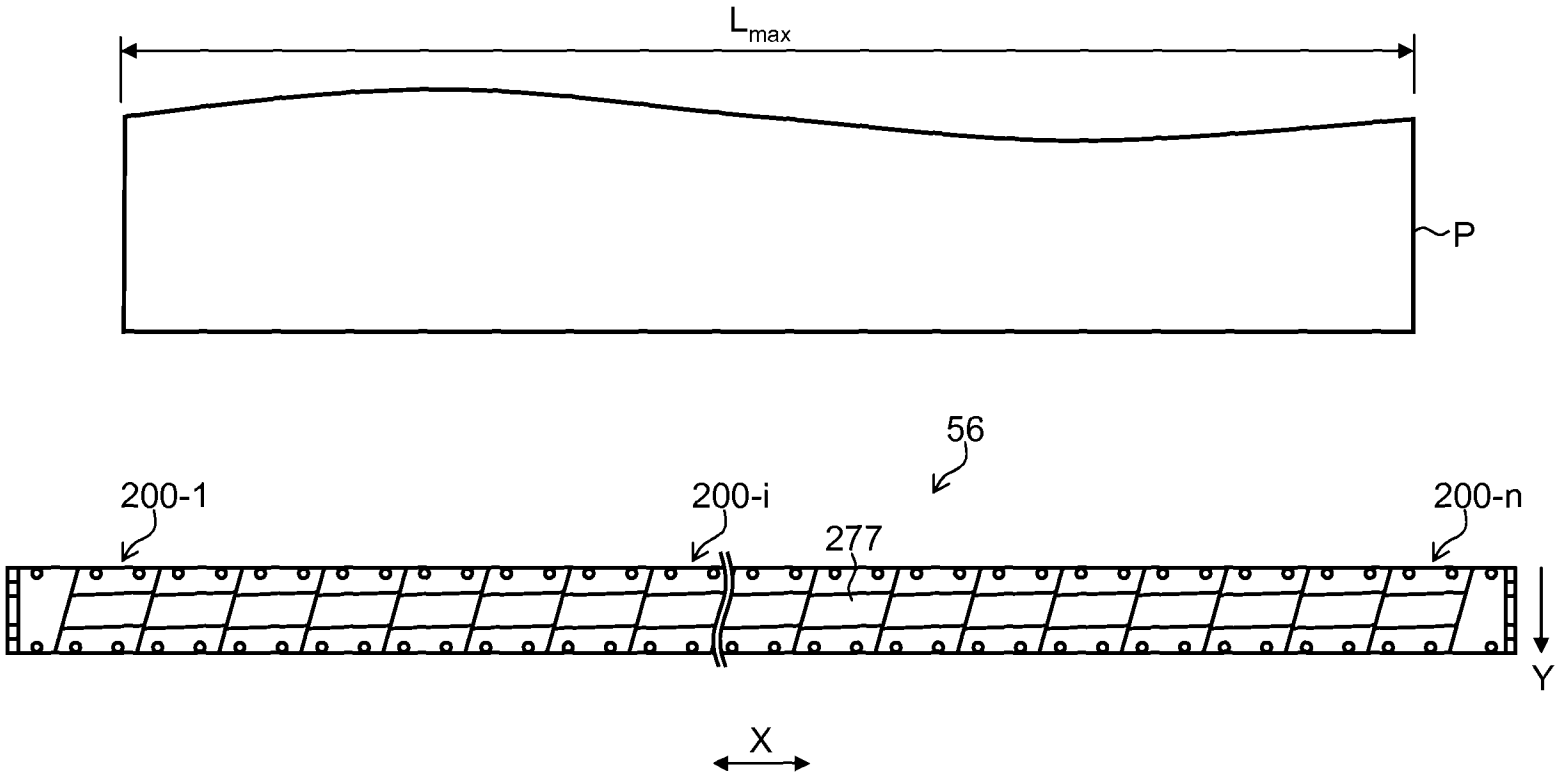
FIG. 3 is a perspective view showing an example of a structure of a head unit shown in FIG. 1.

The inkjet head applied to this example adopts a line type head where nozzles are formed over the length corresponding to the entire width of paper P (the total length in a main scanning direction orthogonal to the relative movement direction of paper P) (see FIG. 3).

The front end of the paper P passed from the process liquid drying drum 46 of the process liquid drying device 16 to the image formation drum 52 is gripped by a gripper 52A of the image formation drum 52. Furthermore, the paper P is caused to pass under the paper pressing roller 54 and thus comes into close contact with the periphery of the image formation drum 52.

The paper P in close contact with the periphery of the image formation drum 52 is sucked by a negative pressure caused through suction holes formed on the periphery of the image formation drum 52, and thus sucked and held on the periphery of the image formation drum 52.

While the paper P sucked and held on the periphery of the image formation drum 52 and conveyed passes through ink deposition areas beneath the respective head units 56C, 56M, 56Y and 56K, droplets of ink having respective colors of C, M, Y and K are ejected from the head units 56C, 56M, 56Y and 56K and deposited on the surface; the deposition prints a color image on the surface.

The ink deposited on the surface of the paper P reacts with the ink aggregation layer formed on the surface of the paper P, and fixed on the surface of the paper P without causing feathering, bleeding and the like, thereby forming a high quality image on the surface of the paper P.

While the paper P on which the image has been formed by the head units 56C, 56M, 56Y and 56K passes through a reading area of the in-line sensor 58, the image formed on the surface is read out.

The image is read out by the in-line sensor 58 as necessary. On the basis of readout data of the image, image failure (image abnormality), such as ejection failure and concentration unevenness, is tested. The paper P having passed through the reading area of the in-line sensor 58 is released from the suction, and subsequently is passed under a guide 59 to the ink drying device 20.

<Ink Drying Device>

The ink drying device 20 includes an ink drying unit 68 which applies a drying process to the paper P conveyed by the chain gripper 64. This device applies the drying process to the paper P on which the image has been formed, thereby removing a liquid component remaining on the surface of the paper P.

An example of the configuration of the ink drying unit 68 is an embodiment including a heat source, such as a halogen heater or an infrared (IR) heater, and a fan for blowing air (gas or fluid) heated by the heat source to the paper P.

The front end of the paper P passed from the image formation drum 52 of the image forming device 18 to the chain gripper 64 is gripped by grippers 64D included in the chain gripper 64.

The chain gripper 64 has a structure including a first sprocket wheel 64A, a second sprocket wheel 64B, and a pair of endless chains 64C wrapped around the wheels.

The underside of the paper P at the rear end is sucked and held by the paper holding surface of a guide plate 72 arranged in a manner of being separated by a prescribed distance from the chain gripper 64.

<UV Irradiation Device>

The UV irradiation device 22 includes a UV irradiation unit 74. This device irradiates the image recorded using the aqueous UV ink with ultraviolet light to fix the image on the surface of the paper P.

When the paper P conveyed by the chain gripper 64 reaches a UV light irradiation area of the UV irradiation unit 74, the UV irradiation unit 74 provided in the chain gripper 64 applies a UV irradiation process.

That is, the paper P conveyed by the chain gripper 64 while the front end is gripped by the gripper and the underside of the rear end is sucked and held by the paper holding surface is irradiated with UV light by the UV irradiation unit 74 arranged at a position corresponding to the surface of the paper P in a conveyance path for the paper P. In the image (ink) irradiated with the UV light, curing reaction occurs, and the image is fixed to the surface of the paper P.

The paper P subjected to the UV irradiation process passes through an inclined conveyance path 70B and is then conveyed to the paper ejection device 24. A cooling processor which applies a cooling process to the paper P passing through the inclined conveyance path 70B may be provided.

<Paper Ejection Device>

The paper ejection device 24, which collects the paper P having been subjected to a series of image forming process, includes a paper ejection table 76 which collects sheets of the paper P in a stacked manner.

The chain gripper 64 (grippers 64D) releases the paper P on the paper ejection table 76, and stacks sheets of paper P on the paper ejection table 76. The paper ejection table 76 collects the sheets of paper P released from the chain gripper 64 in a stacked manner. The paper ejection table 76 is provided with paper regulators (a front paper regulator, a rear paper regulator, side paper regulators, etc.), not shown, for stacking sheets of paper P in an orderly manner.

The paper ejection table 76 is arranged in a manner capable of ascending and descending by means of a paper ejection table ascent and descent device, not shown. The paper ejection table ascent and descent device is controlled to be driven according to increase and decrease of sheets of paper P stacked on the paper ejection table 76, and raises and lowers the paper ejection table 76 so as to always keep the top of paper P at a prescribed height.

<Description on Control System>

Figure 2:
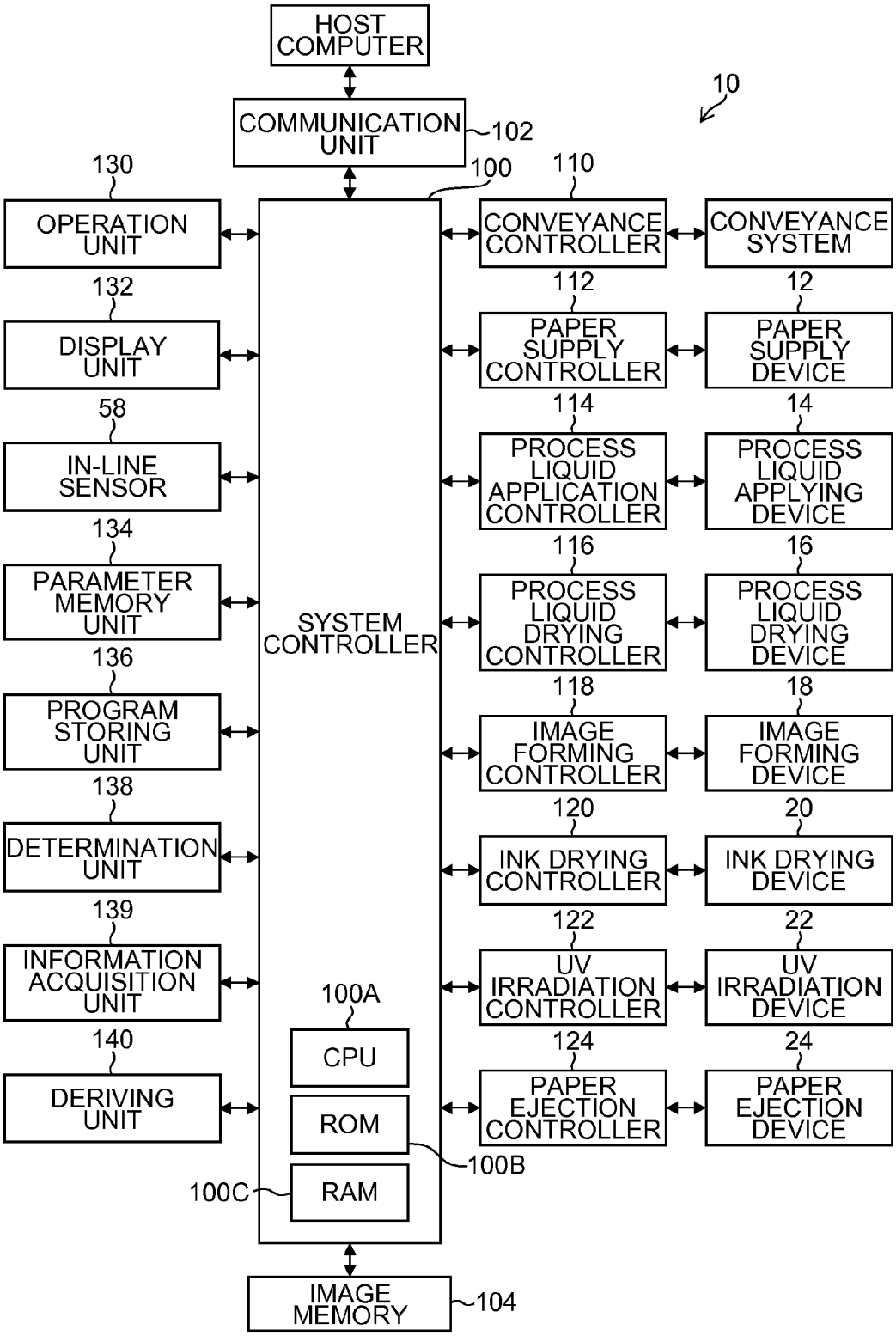
FIG. 2 is a block diagram showing a schematic configuration of a control system in the inkjet recording apparatus shown in FIG. 1.

FIG. 2 is a block diagram showing a schematic configuration of a control system of the inkjet recording apparatus 10 shown in FIG. 1.

As shown in this diagram, the inkjet recording apparatus 10 includes: a system controller 100; a communication unit 102; an image memory 104; a conveyance controller 110; a paper supply controller 112; a process liquid application controller 114; a process liquid drying controller 116; an image forming controller 118; an ink drying controller 120; a UV irradiation controller 122; a paper ejection controller 124; an operation unit 130; a display unit 132, and the like.

The system controller 100 functions as a control device which controls the elements of the inkjet recording apparatus 10 in an integrated manner, and also functions as a computation device which performs various computation processes. The system controller 100 internally includes a CPU (central processing unit) 100A, a ROM (read only memory) 100B, and a RAM (random access memory) 100C.

The system controller 100 also functions as a memory controller which controls writing of data onto the memories, such as the ROM 100B, the RAM 100C and the image memory 104, and reading of the data from the memories.

FIG. 2 exemplifies the embodiment in which the system controller 100 internally includes the memories, such as the ROM 100B and the RAM 100C. Alternatively, the memories, such as ROM 100B and the RAM 100C, may be provided outside of the system controller 100.

The communication unit 102 includes a required communication interface, and transmits and receives data to and from a host computer connected to the communication interface.

The image memory 104 functions as a temporary memory device for storing various pieces of data including image data. The data is read and written via the system controller 100. The image data received from the host computer via the communication unit 102 is temporarily stored in the image memory 104.

The conveyance controller 110 controls operations of a conveyance system for the paper P in the inkjet recording apparatus 10 (conveyance of the paper P from the paper supply device 12 to the paper ejection device 24). The conveyance system includes: the process liquid applying drum 42 in the process liquid applying device 14 shown in FIG. 1; the process liquid drying drum 46 in the process liquid drying device 16; the image formation drum 52 in the image forming device 18; and the chain gripper 64 which is commonly used by the ink drying device 20, the UV irradiation device 22 and the paper ejection device 24 (see FIG. 1).

The paper supply controller 112 controls operations of the elements of the paper supply device 12, i.e., driving of the paper supply roller pair 34, driving of the tape feeder 36A and the like, according to instructions from the system controller 100.

The process liquid application controller 114 controls operations (the amount of application of process liquid, application timing, etc.) of the elements of the process liquid applying device 14, i.e., operations of the process liquid applying unit 44 and the like, according to instructions from the system controller 100.

The process liquid drying controller 116 controls operations of the elements of the process liquid drying device 16, according to instructions from the system controller 100. That is, the process liquid drying controller 116 controls operations of the process liquid drying unit 50 (see FIG. 1), such as drying temperature, the flow rate of drying air, and timing of blowing drying air.

The image forming controller 118 controls ink deposition (ejection) from the image forming device 18 (head units 56C, 56M, 56Y and 56K, see FIG. 1) according to instructions from the system controller 100.

That is, the image forming controller 118 in FIG. 2 includes: an image processor (not shown) which forms dot data from input image data; a waveform generator (not shown) which generates a waveform of a drive voltage; a waveform memory (not shown) which stores the waveform of the drive voltage; and a drive circuit (not shown) which supplies the head units 56C, 56M, 56Y and 56K with the drive voltages having drive waveforms corresponding to the dot data.

The image processor performs a color separation process of separating input image data (raster data represented as digital values from 0 to 255) into data having RGB colors, correction processes, such as a color conversion process of converting the RGB into CMYK, a gamma correction and a unevenness correction, and a halftone process of converting the data with each color having an M value into the data with each color having an N value (M>N; M is an integer of at least three; and N is an integer of at least two).

On the basis of dot data generated through a process by the image processor, deposition timing and the amounts of ink deposition at each pixel position are determined Drive voltages and drive signals (a control signal for determining deposition timing of each pixel) according to the deposition timing and the amounts of ink deposition at each pixel position are generated. These drive voltages are supplied to head units 56C, 56M, 56Y and 56K. Ink droplets ejected from the head units 56C, 56M, 56Y and 56K form dots at the respective pixel positions.

The ink drying controller 120 controls operations of the ink drying device 20 according to instructions from the system controller 100. That is, the ink drying controller 120 controls operations of the ink drying unit 68 (see FIG. 1), such as the drying temperature, the flow rate of the drying air, and the timing of ejecting drying air.

The UV irradiation controller 122 controls the amount of UV light (irradiation energy of UV light) from the UV irradiation device 22 according to instructions from the system controller 100, and also controls the timing of UV light irradiation.

The paper ejection controller 124 controls operations of the paper ejection device 24 such that sheets of the paper P are stacked on the paper ejection table 76 (see FIG. 1), according to instructions from the system controller 100.

The operation unit 130 includes operation members, such as operation buttons, a keyboard and a touch panel, and outputs, to the system controller 100, operation information input from the operation members. The system controller 100 performs various processes according to the operation information output from the operation unit 130.

The display unit 132 includes a display device, such as an LCD panel, and causes the display device to display information including various pieces of setting information of the apparatus and abnormality information, according to instructions from the system controller 100.

The detected signals (detected data) output from the in-line sensor 58 are subjected to processes, such as noise removal and waveform shaping, and stored in a predetermined memory (e.g., RAM 100C) through the system controller 100.

A parameter memory unit 134 is a device that stores various parameters used by the inkjet recording apparatus 10. The various parameters stored in the parameter memory unit 134 are read through the system controller 100, and set in each unit of the apparatus.

A program storing unit 136 is a device that stores programs used for each unit of the inkjet recording apparatus 10. The various programs stored in the program storing unit 136 are read through the system controller 100 and executed in each unit of the apparatus.

A determination unit 138 is a device that, when forming an image including a high concentration region (first concentration region) and a low concentration region (second concentration region), determines whether concentration unevenness caused by mechanical crosstalk due to vibrations of a portion of the inkjet head forming the high concentration region is visible or not.

When the information acquisition unit 139 (concentration unevenness information acquisition device) acquires concentration unevenness information on which the determination unit 138 determines that the concentration unevenness is visible, a changing parameter is derived by the deriving unit 140 (an example of an adjustment device), and image adjustment or position adjustment of the inkjet head is executed (described later in detail) on the basis of the derived changing parameter.

[Structure of Inkjet Head Unit]

Next, the structure of the inkjet head unit according to the embodiment of the present invention is described in detail.

<Overall Configuration>

FIG. 3 is a configurational diagram of the head units 56C, 56M, 56Y and 56K shown in FIG. 1. The same structure is applied to the head units 56C, 56M, 56Y and 56K corresponding to the respective CMYK colors. Accordingly, in the case where the heads are not required to be discriminated, alphabetical characters of the head units 56C, 56M, 56Y and 56K may be omitted.

The head unit 56 shown in FIG. 3 has a structure where multiple inkjet heads 200 are coupled together in the width direction of the paper P (an X direction, a first direction) orthogonal to the relative conveyance direction of the paper P (a Y direction).

A suffix number (an integer after "-" (hyphen)) appended to the inkjet head 200 designates that the module is the i-th (an integer from 1 to n) head module.

Figure 5:
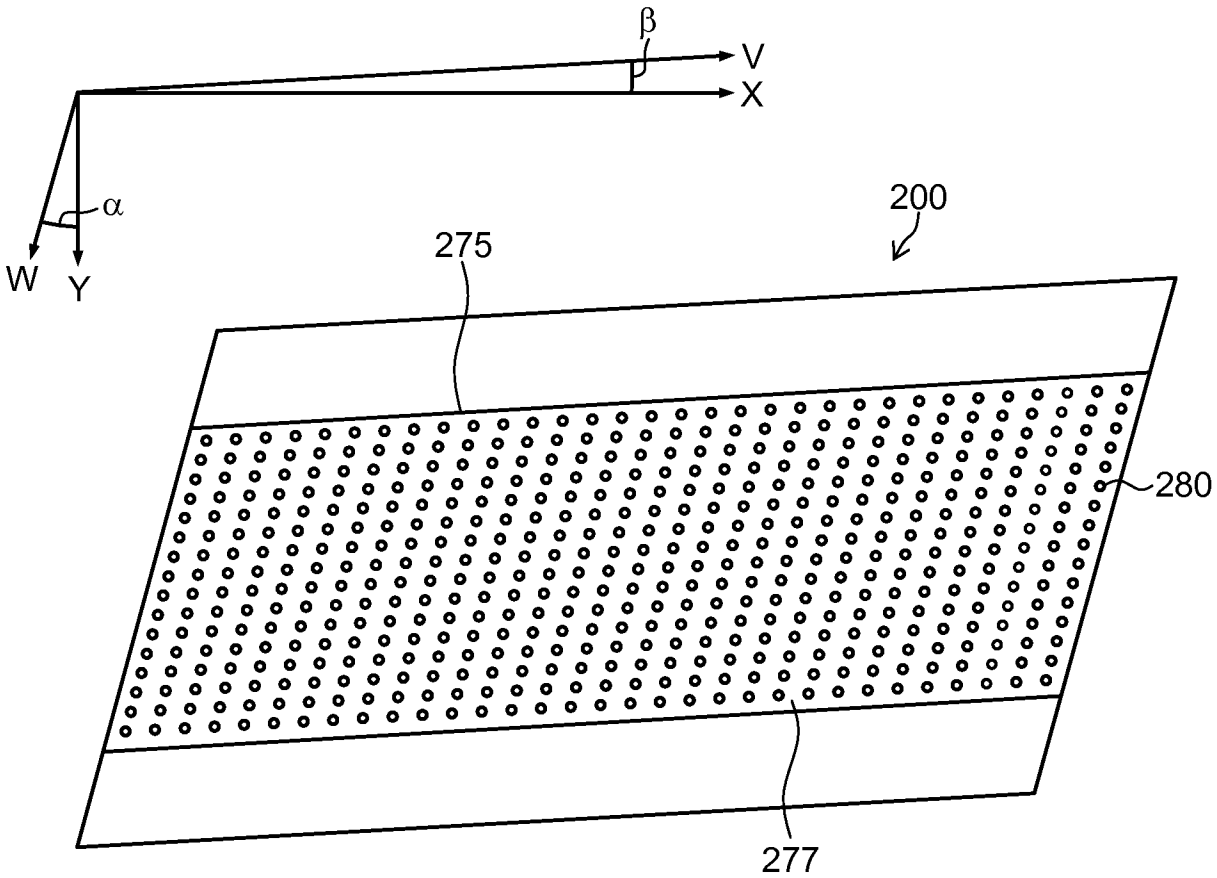
FIG. 5 is a plan perspective view of a nozzle surface of the inkjet head shown in FIG. 3.

An ink ejection surface 277 of each inkjet head 200 has a plurality of nozzle openings (not shown in FIG. 3; shown using reference numeral 280 in FIG. 5).

That is, the head unit 56 shown in FIG. 3 is a full line type inkjet head (single-pass and page-wide head) in which a plurality of nozzle openings are arranged across a length corresponding to the total width $L_{max}$ of the paper P.

Here, "the total width $L_{max}$ of the paper P" is a total length of the paper P in the width direction of the paper P.

The term "orthogonal" herein encompasses aspects that exert working-effects analogous to those of the cases of crossing at an angle of substantially 90° among aspects of crossing at an angle less than 90° or an angle exceeding 90°.

This example exemplifies the image forming using the full line type inkjet head in which multiple nozzles are arranged over the length corresponding to the maximum width of the paper P. However, this technique is applicable also to image forming through use of a serial head. In this image forming, scanning is performed along the width direction of the paper P by a short serial head having a length less than the width of the paper P to perform printing in the same direction. After printing in this direction is finished, the paper P is moved by a certain amount in the relative conveyance direction. Printing is performed in the next region in the width direction of the paper P. This operation is repeated and thus printing is performed over the entire surface of the paper P.

<Example of Configuration of Inkjet Head>

Figure 4:
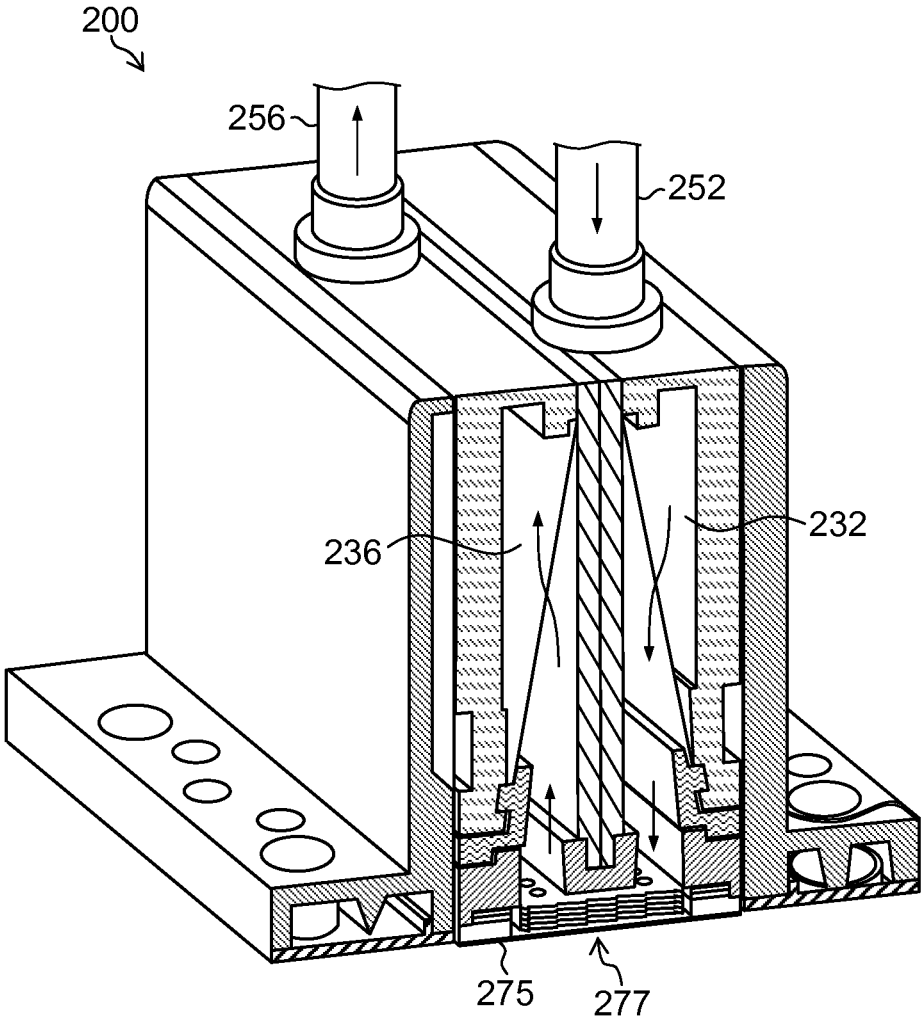
FIG. 4 is a sectional view showing an internal structure of the inkjet head shown in FIG. 3.

FIG. 4 is a perspective view (including a partially sectional view) of the inkjet head 200. FIG. 5 is a perspective plan view of a nozzle surface of the inkjet head 200 shown in FIG. 4.

As shown in FIG. 4, the inkjet head 200 includes an ink supply unit including an ink supply chamber 232, an ink circulation chamber 236 and the like, on a side (upper side in FIG. 4) of the nozzle plate 275 opposite to the ink ejection surface 277.

The ink supply chamber 232 communicates with an ink tank (not shown) via a supply pipe 252. The ink circulation chamber 236 communicates with a collection tank (not shown) via a circulation pipe 256.

In FIG. 5, the number of nozzles is reduced for illustration. However, a plurality of nozzle openings 280 are formed according to a two-dimensional nozzle arrangement on the ink ejection surface 277 of the nozzle plate 275 of one inkjet head 200.

That is, the inkjet head 200 has a planar shape of a parallelogram which has an end face on a longitudinal side along a V direction having an inclination of an angle β from the X direction and an end face on a short side along a W direction having an inclination of an angle α from the Y direction. The plurality of nozzle openings 280 are arranged in a matrix in a row direction along the V direction and a column direction along the W direction.

The arrangement of the plurality of nozzle openings 280 is not limited to the embodiment shown in FIG. 5. Alternatively, the nozzle openings 280 may be arranged in the row direction along the X direction and the column direction obliquely intersecting with the X direction.

That is, according to the matrix arrangement of the nozzle openings 280 (nozzles 281), in the projection nozzle array where each nozzle opening 280 is projected so as to be arranged in the X direction (an example of the first direction), the nozzle openings 280 are arranged so as to achieve a uniform arrangement interval (pitch between nozzles) of the nozzle openings 280.

Figure 6:
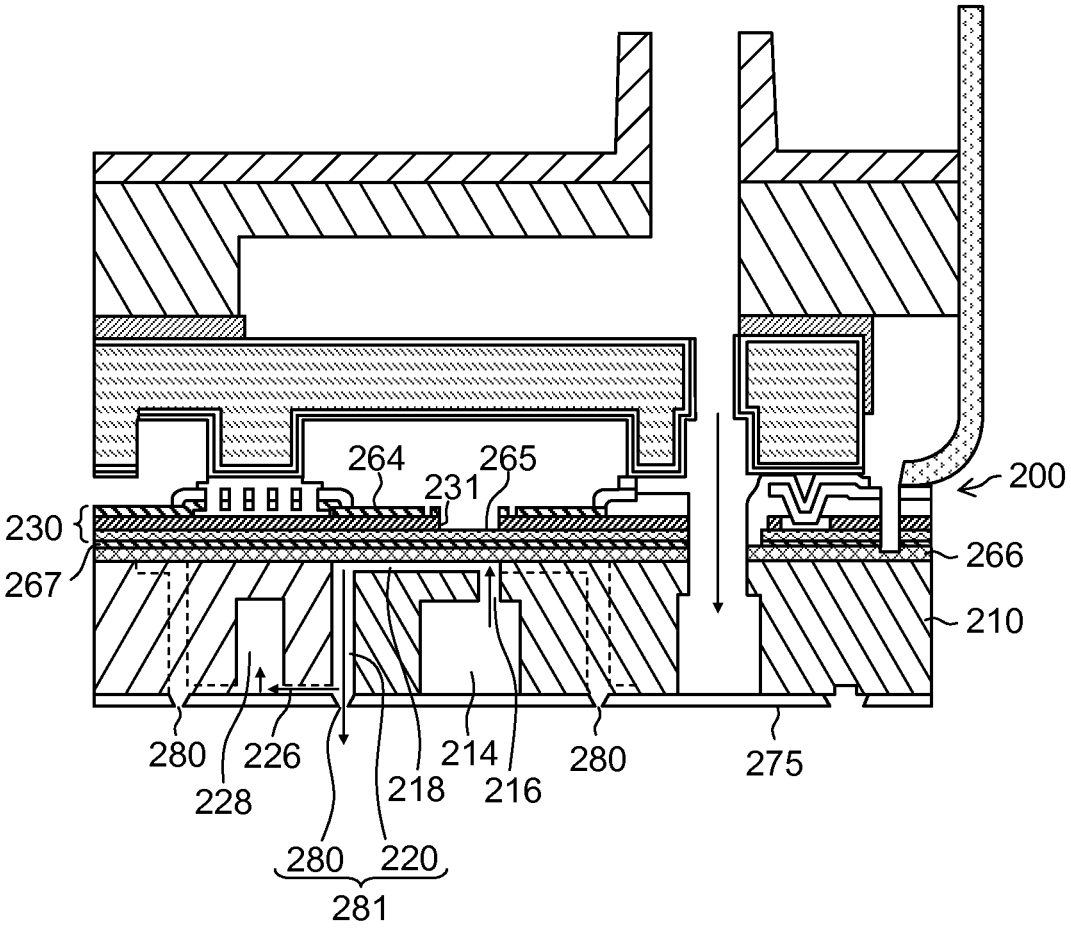
FIG. 6 is a sectional view showing an internal structure of the inkjet head shown in FIG. 3.

FIG. 6 is a sectional view showing an internal configuration of the inkjet head 200. Reference numeral 214 designates the ink supply channel. Reference numeral 218 designates a pressure chamber (liquid chamber). Reference numeral 216 designates an individual supply channel which communicates between the pressure chamber 218 and the ink supply channel 214. Reference numeral 220 designates a nozzle communication channel which communicates from the pressure chamber 218 to the nozzle opening 280. Reference numeral 226 designates an individual circulation channel which communicates between the nozzle communication channel 220 and the common circulation channel 228.

A diaphragm 266 is provided on a channel structure 210 configuring each of these channels (214, 216, 218, 220, 226 and 228). A piezoelectric element 230, which has a stacked structure including a lower electrode (common electrode)

265, a piezoelectric layer 231 and an upper electrode (individual electrode) 264, is arranged on the diaphragm 266 via an adhesive layer 267.

The upper electrode 264 is an individual electrode having been patterned in conformity with the shape of each pressure chamber 218. A piezoelectric element 230 is provided for each pressure chamber 218.

The ink supply channel 214 communicates with the ink supply chamber 232 described with reference to FIG. 4. Ink is supplied from the ink supply channel via the individual supply channel 216 to the pressure chamber 218. A drive voltage is applied to the upper electrode 264 of the piezoelectric element 230 provided for the corresponding pressure chamber 218, according to an image signal of an image to be painted. This application deforms the piezoelectric element 230 and the diaphragm 266, and changes the capacity of the pressure chamber 218. Change in pressure caused owing thereto ejects ink via the nozzle communication channel 220 out of the nozzle opening 280.

Driving of the piezoelectric elements 230 corresponding to the respective nozzle openings 280 is controlled according to dot arrangement data generated from image information, thereby allowing ink droplets to be ejected from the nozzle opening 280. While the paper P (see FIG. 3) is conveyed in the Y direction at a constant speed, timing of ejecting ink from each nozzle opening 280 is controlled in conformity with the conveyance speed, thereby allowing a desired image to be recorded on paper.

Although not shown, the pressure chamber 218 arranged according to each nozzle opening 280 has a planar shape of a substantially regular square. An outlet to the nozzle opening 280 is provided at one of both corners on a diagonal line. An inlet (individual supply channel) 216 for supply ink is provided at the other corner.

The shape of the pressure chamber is not limited to a square. Alternatively, the planar shape of the pressure chamber may be one of various shapes including a quadrilateral (rhombus, rectangle, etc.), a pentagon, a hexagon, another polygon, a circle, and an ellipse.

In the nozzle 281 including the nozzle opening 280 and the nozzle communication channel 220, a circulation outlet (not shown) is formed. The nozzle 281 communicates with the individual circulation channel 226 via the circulation outlet.

A portion of ink in the nozzle 281 which is not used for ejection is collected (circulated) via the individual circulation channel 226 to the common circulation channel 228.

The common circulation channel 228 communicates with the ink circulation chamber 236 described in FIG. 5, and ink is continuously collected through the individual circulation channel 226 to the common circulation channel 228, thereby preventing the ink in the nozzle from thickening during a non-ejection (non-driving) period.

Note that the application scope of the present invention is not limited to the structures shown in FIGS. 4 to 6. The arrangement of the nozzle openings 280 (nozzles 281) may be arranged in line in the width direction of the paper P or arranged in staggered two lines.

An example of the head unit 56 described above may have a configuration that includes 17 inkjet heads 200 arranged in line along the X direction. An example of the inkjet head 200 may have a configuration that includes 2048 ejection elements.

The "ejection element" is a minimum unit having a configuration for ejecting ink, and includes one nozzle 281 (see FIG. 6), a channel (pressure chamber 218 etc. in FIG. 5) accompanying one nozzle 281, and the piezoelectric element 230 corresponding to the nozzle 281.

An example of the piezoelectric element may be the piezoelectric element 230 that has a structure individually separated in conformity with each nozzle 281 in FIG. 6. It is a matter of course that a structure may be adopted where the piezoelectric layer 231 is formed integrally with the multiple nozzles 281, separate electrodes are formed corresponding to the respective nozzles 281, and active regions are formed for the respective nozzles 281.

Hereinafter, configuration examples of inkjet heads and head units that are applicable to the present invention are described.

[Configuration Examples of Inkjet Heads and Head Units]

Figure 7:
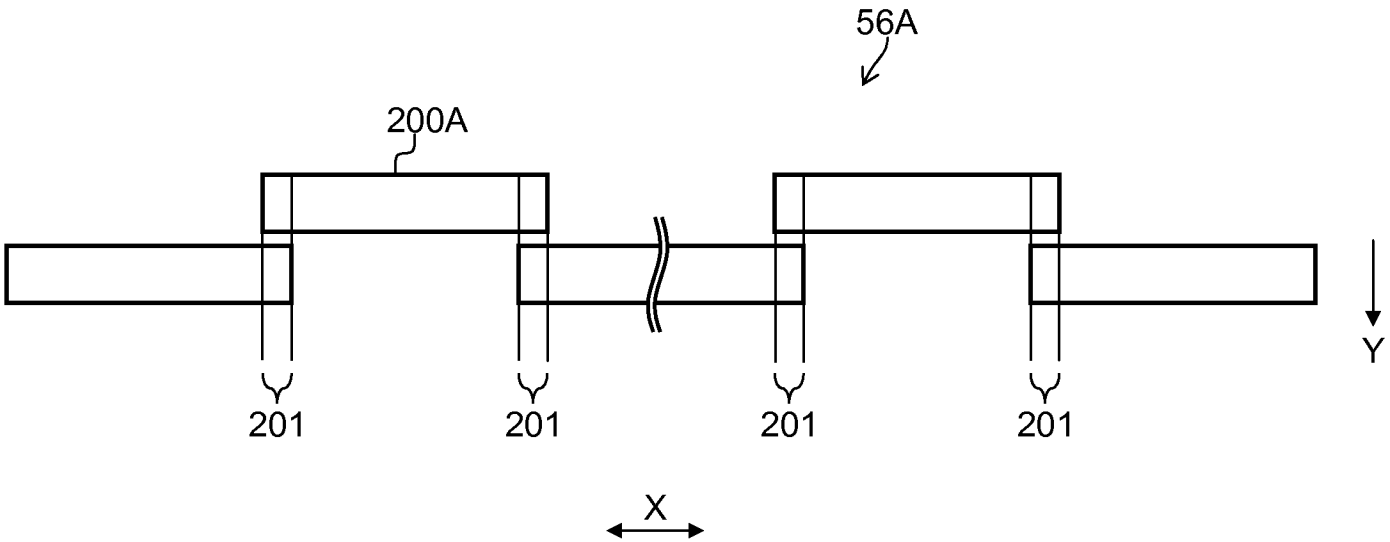
FIG. 7 is a configuration diagram of examples of other structures of the inkjet head and the inkjet head unit.
Figure 8:
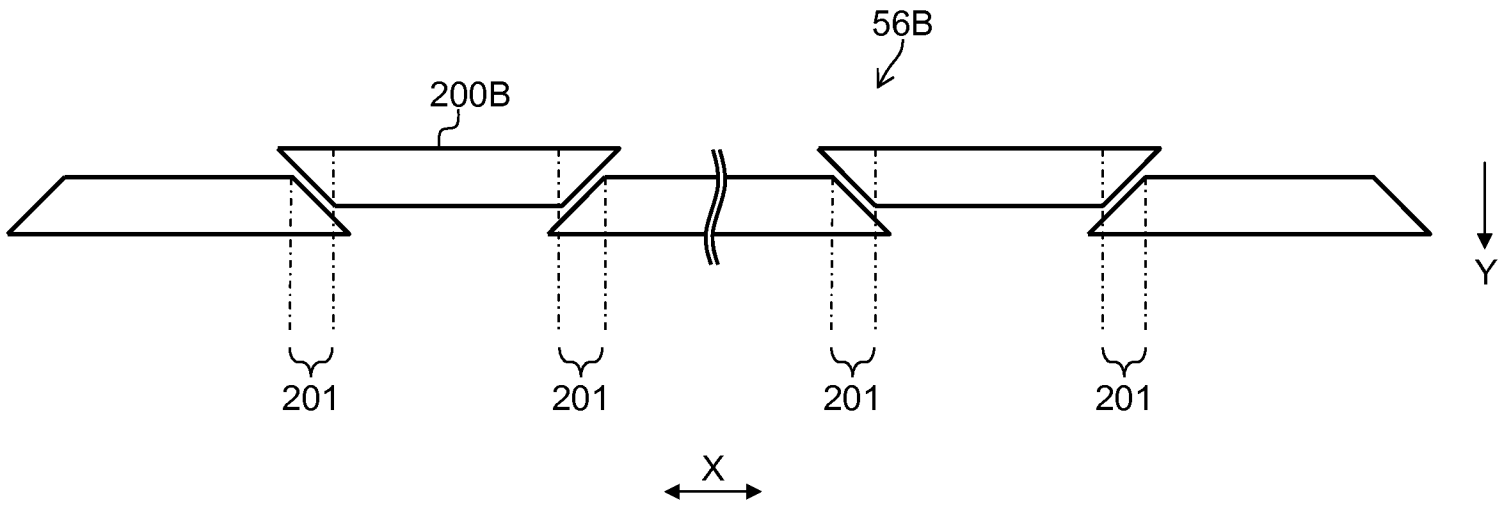
FIG. 8 is a configuration diagram of examples of other structures of the inkjet head and the inkjet head unit.

FIGS. 7 and 8 are diagrams illustrating configuration example of inkjet heads and head units, and plan views of nozzle surfaces. Note that in FIGS. 7 and 8, illustration of the nozzle openings 280 (see FIG. 5) is omitted.

In a head unit 56A shown in FIG. 7, multiple inkjet heads 200A having an ink ejection surface 277 with a rectangular planar shape are arranged in staggered two lines along the X direction. Overlapping nozzles 201 are provided at both ends of each inkjet head 200A in the X direction.

The example of the arrangement described above is applicable to the arrangement of the nozzles 281 (see FIG. 6) of the inkjet heads 200A without specific limitation.

In a head unit 56B shown in FIG. 8, multiple inkjet heads 200B having an ink ejection surface 277 with a trapezoidal planar shape are arranged in line along the X direction. The multiple inkjet heads 200B arranged in line along the X direction are arranged such that upper bases and lower bases are alternately replaced with each other, and the positions of the inkjet heads 200B in the Y direction alternately deviate from each other.

The planar shape and arrangement of the inkjet heads 200 are not limited to the shapes and arrangements shown in FIGS. 3, 7 and 8, and may adopt a shape and an arrangement that secure the continuity of nozzle arrangement of a projected nozzle array described below.

In the inkjet heads 200 shown in FIG. 3, the inkjet heads 200A shown in FIG. 7, and the inkjet heads 200B shown in FIG. 8, the projected nozzles arranged in line along the X direction where the nozzles 281 in non-end portion (shown in FIG. 11 with assigned numeral 200D) are projected in the X direction have regularly arranged arrangement intervals of the nozzles in the X direction. In the case of a resolution in image forming of 1200 dots per inch, the arrangement interval of the nozzles 281 of the projected nozzle array in the X direction is about 21.2 micrometers.

Here, the "overlapping nozzle" shown in FIGS. 7 and 8 with assigned numeral 201 is a region that includes the nozzles 281 respectively belonging to adjacent inkjet heads 200A and 200B in the projected nozzle array in the X direction. The head unit 56 shown in FIG. 3 is also provided with the forgoing overlapping nozzles.

The inkjet heads 200 shown in FIG. 3, the inkjet heads 200A shown in FIG. 7, and the inkjet heads 200B shown in FIG. 8 are provided with the overlapping nozzles 201, and dedicated ejection control is applied to the overlapping nozzles 201, thereby securing continuity of an image at a portion where adjacent inkjet heads 200, 200A and 200B are coupled together.

In FIGS. 3, 7 and 8, the head units 56, 56A and 56B that include the inkjet heads 200, 200A and 200B provided with the overlapping nozzles 201 have been exemplified. However, the present invention is applicable to a head unit including an inkjet head that is not provided with the overlapping nozzles 201 of the present invention.

In FIGS. 3, 7 and 8, the head units 56, 56A and 56B where the multiple inkjet heads 200, 200A and 200B are coupled together have been exemplified. However, the present invention is applicable to an inkjet head having an integrated structure (e.g., the structure where the inkjet head 200 shown in FIG. 5 is extended to have a required length in the X direction).

[Description of Image Forming Method]

Next, an image forming method applied to the inkjet recording apparatus (image forming apparatus) described above is described. In the following description, the same numerals are assigned to elements identical or similar to the elements having already been described. The description thereof is omitted.

<Description of Technical Problem>

Figure 9:
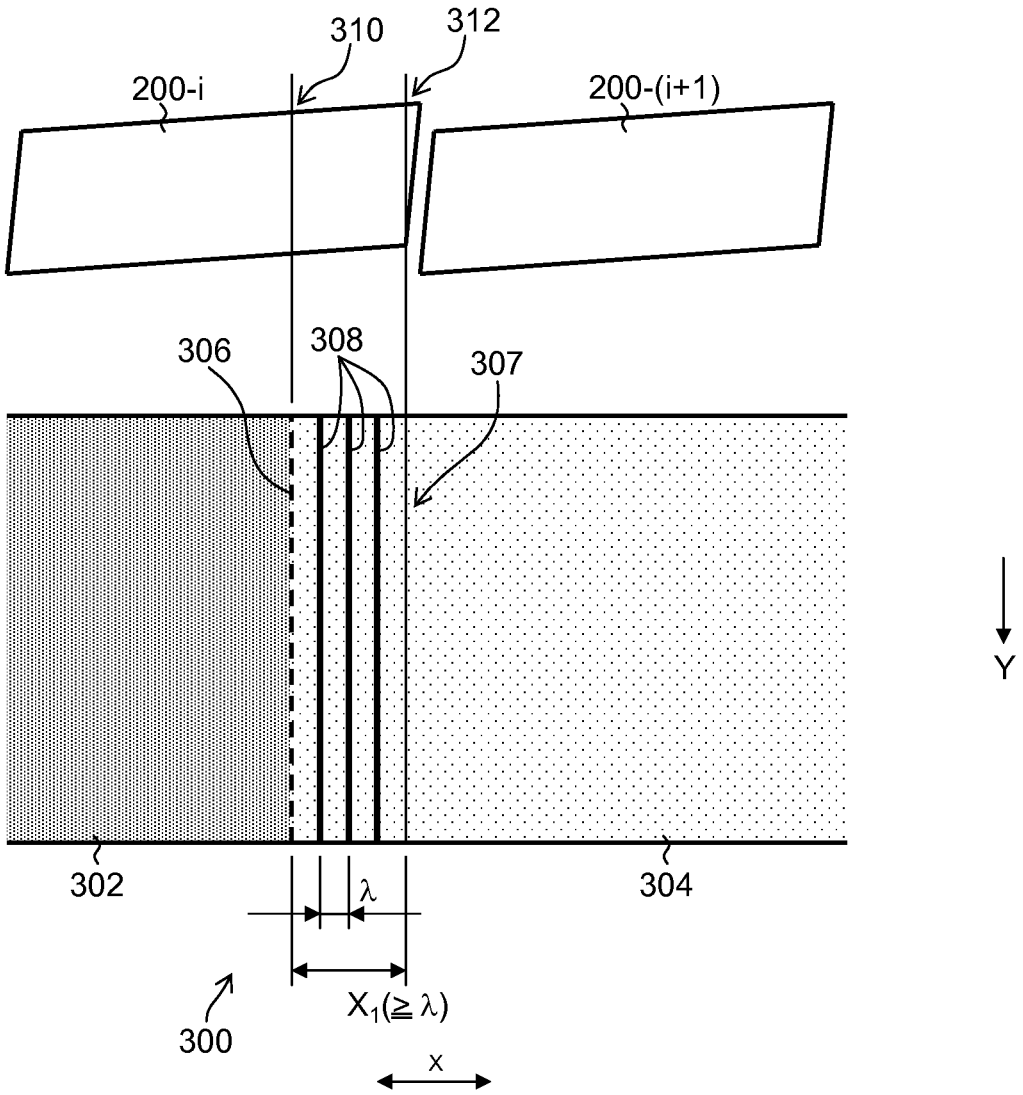
FIG. 9 is a diagram illustrating concentration unevenness occurring in a concentration boundary region in a low concentration region.

FIG. 9 is a diagram illustrating concentration unevenness occurring in a concentration boundary region of a low concentration region. The inkjet heads 200-*i* and 200-(i+1) shown in this diagram are any two adjacent inkjet heads included in the head unit 56 shown in FIG. 3.

An image 300 shown in FIG. 9 is an image arranged at a position where a high concentration region 302 (first concentration region) and a low concentration region 304 (second concentration region) are adjacent to each other. In the image 300, concentration unevenness 308 occurs from a concentration boundary 306 to a concentration boundary region 307 along the X direction in the low concentration region 304. The concentration unevenness 308 is visible as a linear shade pattern along the Y direction.

The inkjet head 200-*i* forms the high concentration region 302 and a part of the low concentration region 304, and the inkjet head 200-(i+1) forms the low concentration region 304.

A single path system is applied to image forming through use of the inkjet head 200-*i* and the inkjet head 200-(i+1). The single path system is, for instance, a system that relatively moves the paper P in FIG. 3 and the inkjet heads 200-*i* and 200-(i+1) in the Y direction only one time to form an image on the entire surface of the paper.

An example of the brightness of the high concentration region 302 in the image 300 where the concentration unevenness 308 is visible may be L=13 in the CIE color space. An example of brightness of the low concentration region 304 may be L=47 in the CIE color space.

Note that the above brightnesses are only examples. There are a region having a relatively low brightness value, and a region having a relatively high brightness value. If concentration unevenness is visible in the region having the relatively high brightness value, the region having the relatively low brightness value is regarded as a high concentration region and the region having the relatively high brightness value is regarded as a low concentration region, and the image forming method described below is applicable.

The inventors of the present invention change image forming conditions (the deposition (ejection) frequency, gradation (concentration) values, etc.) of the inkjet heads 200-*i* and 200-(i+1), and evaluate the concentration unevenness 308. As a result, it became apparent that the wavelength λ of typical concentration unevenness 308 was at least one millimeter and less than or equal to 10 millimeters.

The wavelength λ of the concentration unevenness 308 varies according to the conditions, such as the structure of the inkjet head 200 and ink types (physical properties). The wavelength λ of concentration unevenness 308 can be acquired by actual measurement.

The "wavelength λ of concentration unevenness" is the reciprocal of the spatial frequency of the concentration unevenness 308. In other words, the distance in the X direction between adjacent thick patterns (lines) in the concentration unevenness 308 is measured, and the measured value can be set to the "wavelength λ of concentration unevenness".

Mechanical crosstalk of the inkjet head 200-*i* can be considered a cause of occurrence of the concentration unevenness 308. The mechanical crosstalk is a phenomenon where the ejection efficiency of the nozzle 281 corresponding to the other piezoelectric element 230 varies as a result of transmission of vibrations due to operations of any piezoelectric element 230 (see FIG. 6) that functions as an ejection pressure generation device to another piezoelectric element 230.

That is, vibrations of the piezoelectric elements 230 corresponding to the nozzles 281 that form the high concentration region 302 where frequent operation is made at a high duty are propagated to the piezoelectric elements 230 corresponding to the nozzles 281 that form the low concentration region 304 to change the ejection efficiencies of the piezoelectric elements 230 corresponding to the nozzles 281 that form the low concentration region 304, thereby resultantly causing the concentration unevenness 308 in the concentration boundary region 307 in the low concentration region 304.

Occurrence situations of the concentration unevenness 308 was reviewed. It thus became apparent that the distance $X_1$ from the boundary position 310 of the inkjet head 200-*i* corresponding to the concentration boundary 306 on the image 300 to the low concentration region end 312 (second concentration region end) of the inkjet head 200-*i* in the X direction was a value ($X_1 \geq \lambda$) at least the wavelength λ of the concentration unevenness 308.

The image forming method described below can reduce the visibility of the concentration unevenness 308 that occurs in the concentration boundary region 307 in the low concentration region 304 on the image 300 (including the concentration boundary 306) where the high concentration region 302 and the low concentration region 304 are adjacent to each other, and form a high quality image.

<Detailed Description of Image Forming Method>

Figure 10:
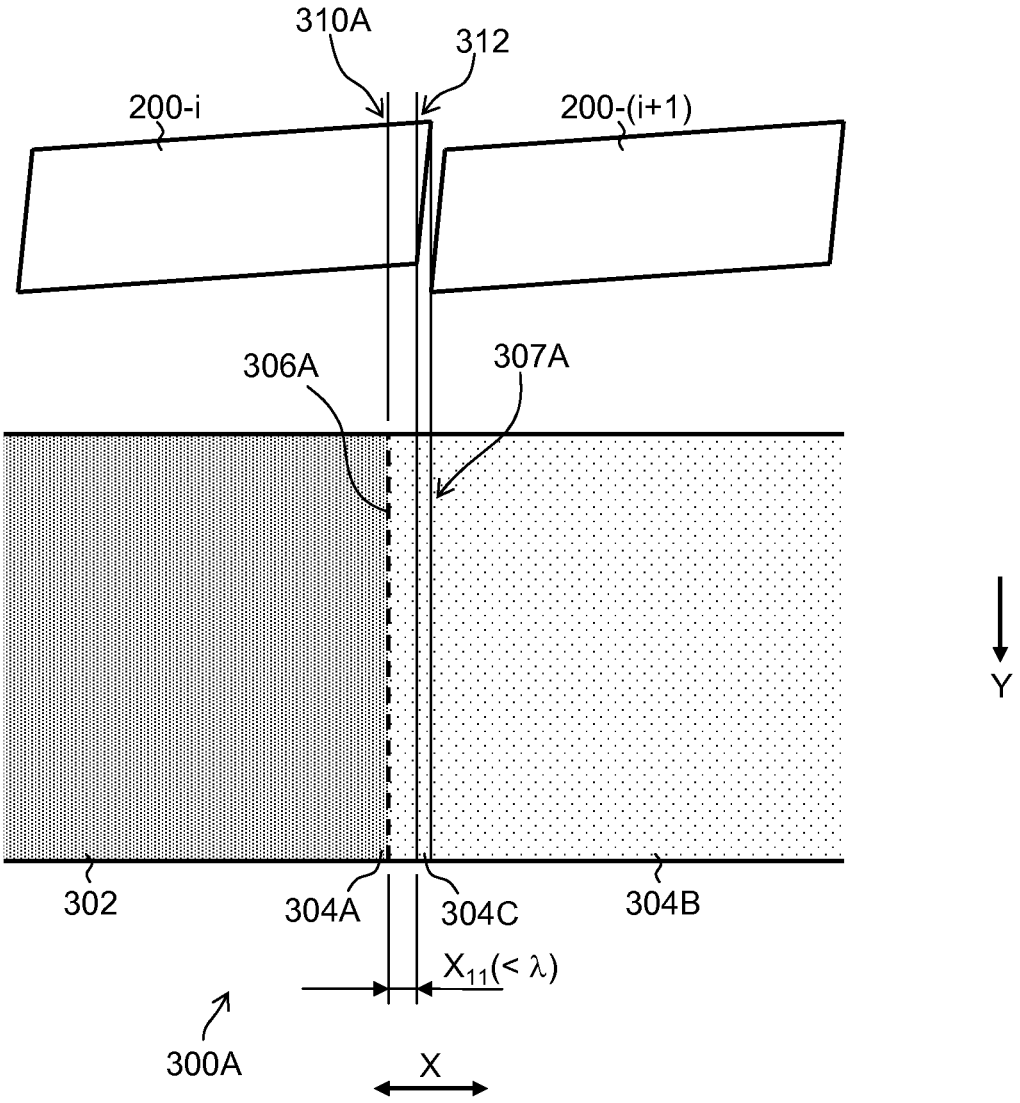
FIG. 10 is a conceptual diagram of an image forming method according to an embodiment of the present invention.

FIG. 10 is a conceptual diagram of an image forming method according to an embodiment of the present invention. In the following description, the wavelength λ of the concentration unevenness 308 (see FIG. 9) is 10 millimeters, and the lengths of the overlapping nozzles 201 (see FIGS. 7 and 8) of the inkjet head 200-*i* in the X direction are two millimeters.

In the image forming method described in this example, as with the image 300 shown in FIG. 9, when concentration unevenness information that represents "the concentration unevenness 308 is visible" is acquired (a concentration unevenness information acquisition step), the relative positions of the inkjet head 200-*i* and the image 300A (an image arranged at a position where the high concentration region 302 and the low concentration region 304 are adjacent to each other, as with the image 300 shown in FIG. 9) are adjusted (adjustment step).

After the adjustment, the distance $X_{11}$ in the X direction from the boundary position 310A of the inkjet head 200-*i* corresponding to the concentration boundary 306A on the image 300 to the low concentration region end 312 satisfies a condition of being less than the wavelength of the concentration unevenness 308 ($X_{11} < \lambda$).

Instead of the adjustment of the relative positions of the inkjet head 200-*i* and the image 300A, the image 300 (see FIG. 9) may be reduced or enlarged (adjustment step), and the distance $X_{11}$ in the X direction from the boundary position 310A of the inkjet head 200-*i* corresponding to the concentration boundary 306A to the low concentration region end 312 on the image 300 may satisfy the condition of being less than the wavelength of the concentration unevenness 308 ($X_{11}<\lambda$).

Meanwhile, the distance $X_i$ in the X direction from the boundary position 310 of the inkjet head 200-*i* corresponding to the concentration boundary 306 to the low concentration region end 312 of the inkjet head 200-(i+1) on the image 300 shown in FIG. 9 satisfies a relationship of being at least the wavelength λ of the concentration unevenness 308 ($X_1\geq\lambda$).

That is, the distance $X_{11}$ in the X direction from the boundary position 310A of the inkjet head 200-*i* that forms the high concentration region 302 and the low concentration region 304 to the low concentration region end 312 is set to be less than the wavelength λ of the concentration unevenness 308, thereby causing the distance in the X direction of a low concentration region 304A formed by non-end portion (shown in FIG. 11 with assigned numeral 200D) where overlapping nozzles 201 of the inkjet head 200-*i* are excluded to be less than one period of the concentration unevenness 308. Accordingly, the thick line is not formed, or, if the thick line is formed, the number of lines is only one.

If multiple shade waves exist (multiple thick lines exist), the shade waves (concentration unevenness 308) become easily visible. However, if only one thick line exists, the concentration unevenness 308 is difficult to be viewed. If no thick line exists, the concentration unevenness 308 is not viewed.

Vibrations of the piezoelectric element 230 (see FIG. 6) of the inkjet head 200-*i* are not propagated to the mechanically separated inkjet head 200-(i+1). Accordingly, in the low concentration region 304B formed by the inkjet head 200-(i+1), no concentration unevenness 308 due to mechanical crosstalk occurs.

At the overlapping nozzles 201, the nozzles 281 belonging to the inkjet head 200-*i* (see FIG. 6) and the nozzles 281 belonging to the inkjet head 200-(i+1) contribute image forming, and thus are resistant to vibrations of the piezoelectric element 230 forming the high concentration region 302 of the inkjet head 200-*i*. In the low concentration region 304C formed by the overlapping nozzles 201, the concentration unevenness 308 caused by mechanical crosstalk does not occur.

Figure 11:
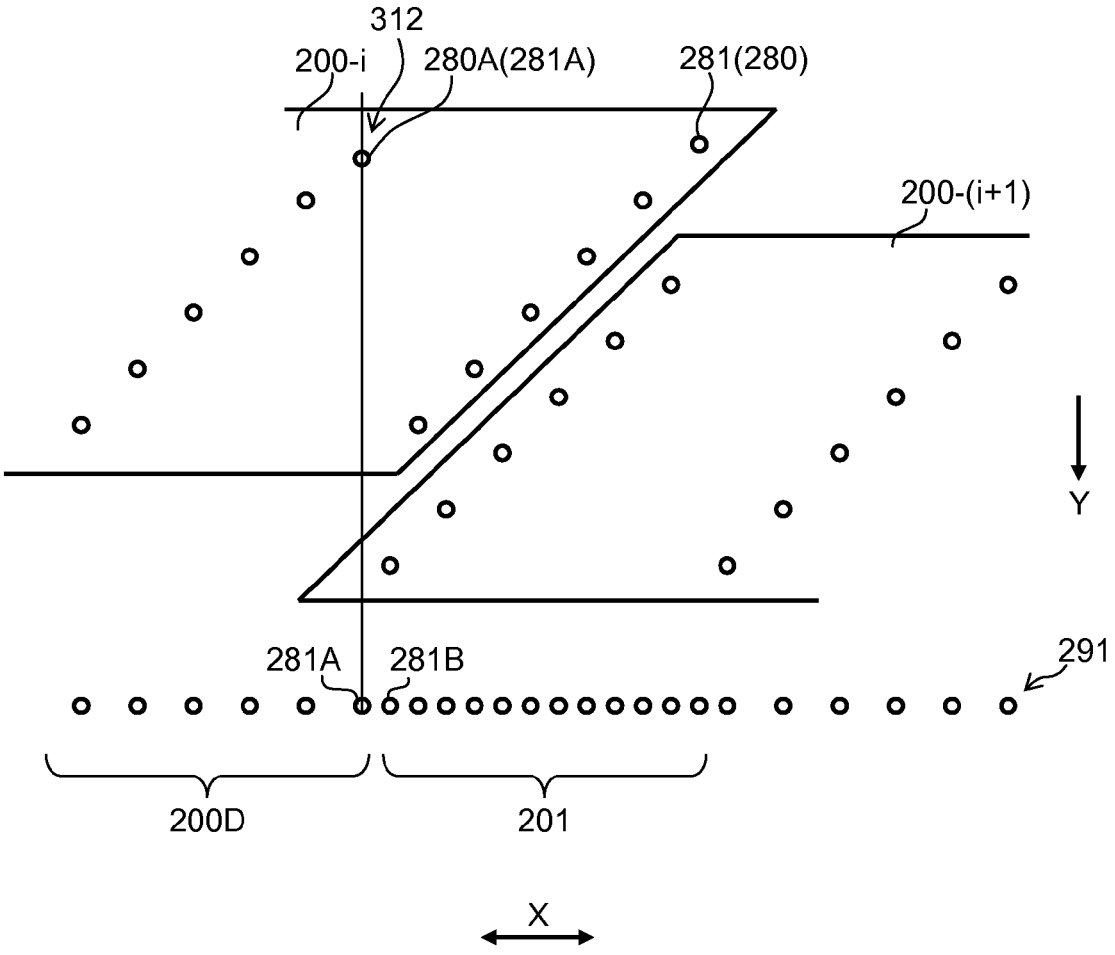
FIG. 11 is a diagram illustrating a low concentration region end.

Here, the "low concentration region end" is described. FIG. 11 is a diagram illustrating a low concentration region end, and shows the overlapping nozzles 201 of the inkjet head 200-*i* and the overlapping nozzles 201 of the inkjet head 200-(i+1) shown in FIG. 10 in an enlarged manner.

The low concentration region end 312 of the inkjet head 200-*i* shown in FIG. 11 is at the position of the nozzle 281A of the non-end portion 200D of the inkjet head 200-*i* that is nearest to the overlapping nozzles 201 (the center position of the nozzle opening 280A).

As to the low concentration region end 312 of the inkjet head 200-*i*, any of positions from the position which is of the nozzle 281A in the non-end portion 200D only including the nozzles 281 belonging to the inkjet head 200-*i* and which is nearest to the overlapping nozzles 201 to the position of the nozzle 281B of the overlapping nozzles 201 nearest to the non-end portion 200D in the projected nozzle array 291 in the X direction may be adopted as the low concentration region end 312.

As described above, the nozzles 281 among the overlapping nozzles 201 are resistant to effects of mechanical crosstalk. Accordingly, the end of the inkjet head 200-*i* portion susceptible to adverse effects of mechanical crosstalk is regarded as the low concentration region end 312.

Figure 12:
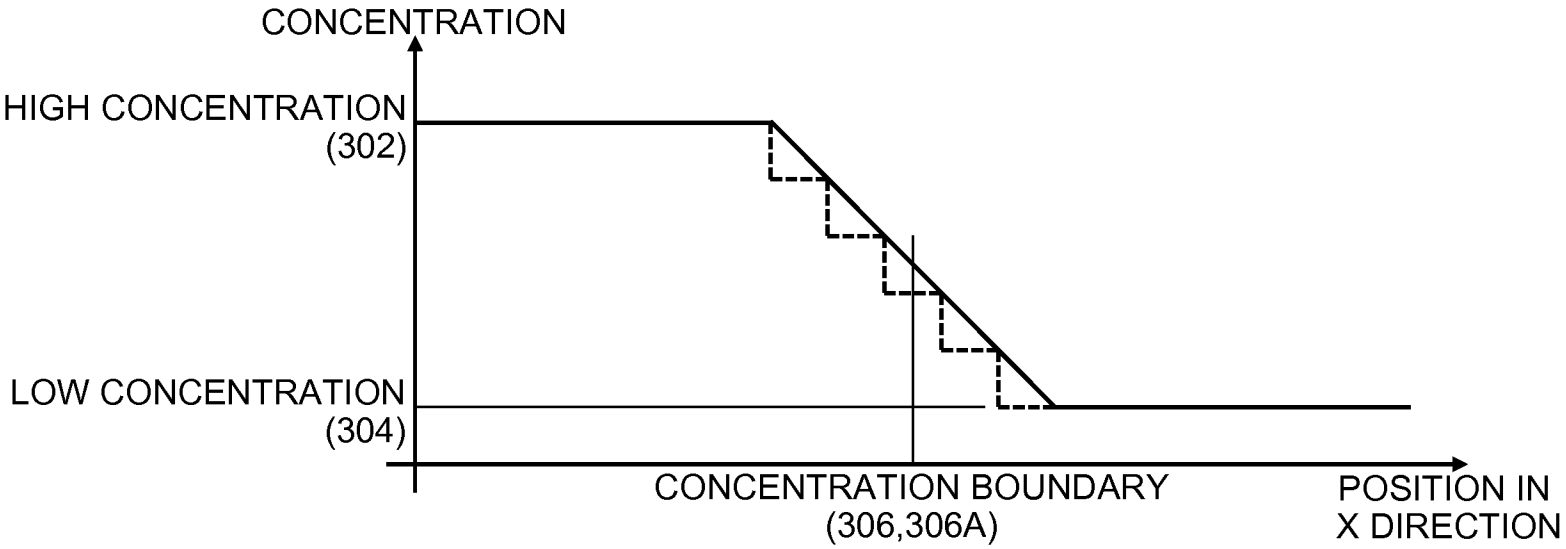
FIG. 12 is a diagram illustrating another aspect of a concentration boundary.

FIG. 12 is a diagram illustrating another aspect of a concentration boundary 306 (306A). The ordinate axis in FIG. 12 is the concentration, and the abscissa axis is the position in the X direction. There may be a case where the concentration boundary 306 continuously changes in the X direction (shown by solid lines), and a case where the boundary changes stepwise (shown by broken lines). In the image forming method described in this example, an intermediate position in the X direction in the region where the concentration changes is regarded as a representative position of the concentration boundary. Note that the concentration boundary 306 (306A) may change in concentration discontinuously (irregularly). If the concentration changes discontinuously (irregularly), either of both ends is regarded as the representative position.

Hereinafter, a specific embodiment of adjusting the relative positional relationship between the image and the inkjet head is described in detail. In a first embodiment, a second embodiment and a third embodiment, which are described later, a full line type head unit 56 that has the structure where 17 inkjet heads 200 are coupled together along the X direction is used to form an image on the entire surface of the paper P according to a single path system.

The hyphenated numbers (numeric values subsequent to hyphens) of inkjet heads 200-1 to 200-17 included in the head unit 56 are assigned such that the inkjet head at the left end in each diagram is regarded as a first and the values are assigned in ascending order from the left to the right.

First Embodiment

Figure 13:
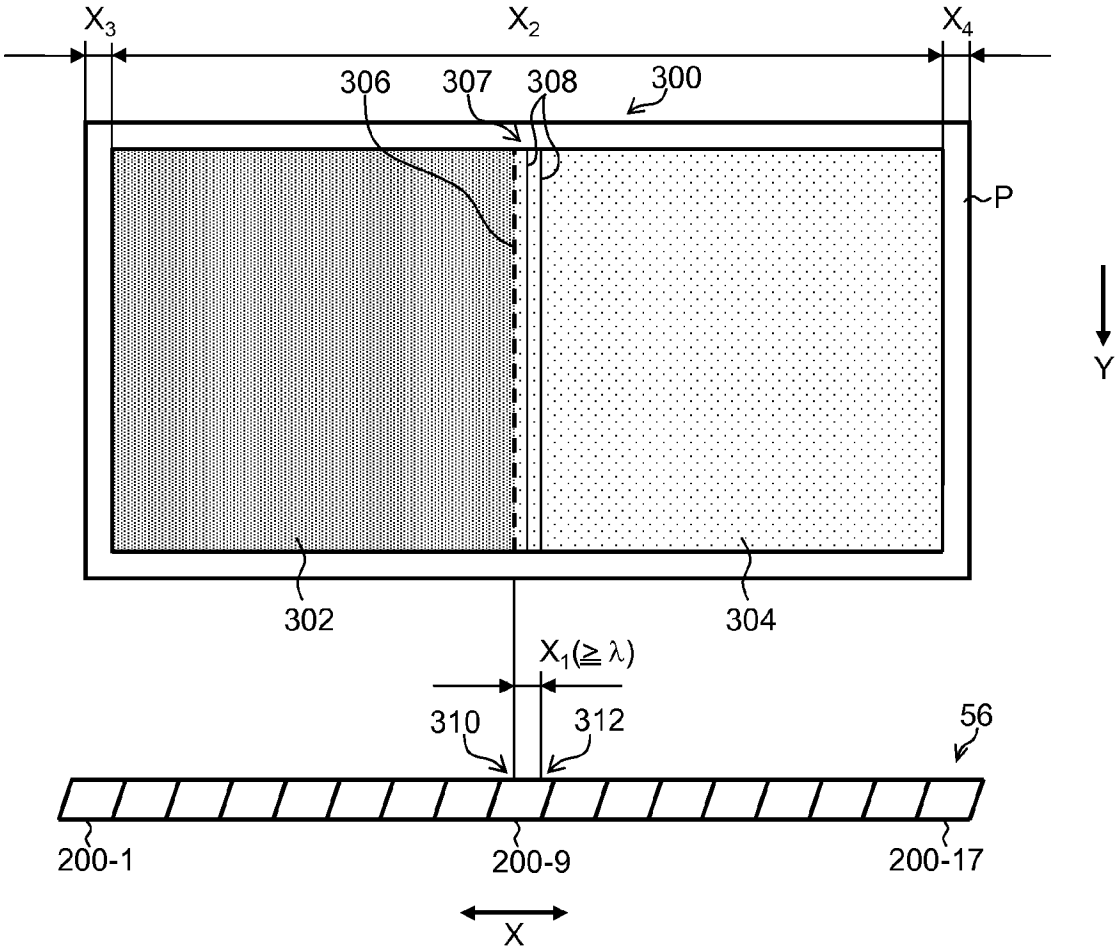
FIG. 13 is a diagram illustrating relative positions between an image where concentration unevenness is visible and an inkjet head (diagram illustrating a first embodiment)
Figure 14:
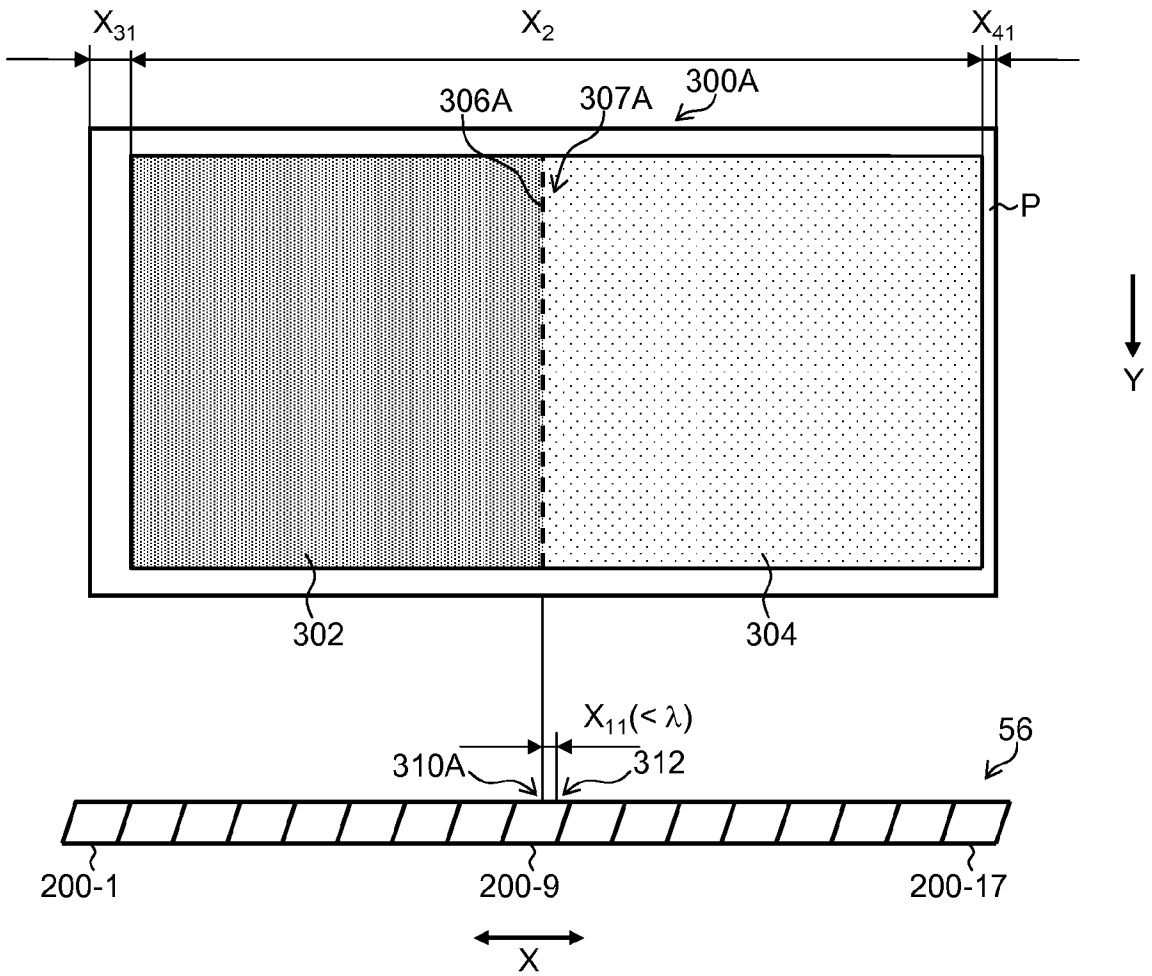
FIG. 14 is a diagram illustrating relative positions between an image where concentration unevenness is not visible and an inkjet head (diagram illustrating the first embodiment)

Referring to FIGS. 13 and 14, an image forming method according to the first embodiment is described. In the first embodiment described below, the position of an image in the X direction is adjusted to reduce the visibility of the concentration unevenness 308.

FIG. 13 is a diagram illustrating relative positional relationships between an image 300 where concentration unevenness 308 is visible and an inkjet head 200 (head unit 56). FIG. 14 is a diagram illustrating relative positional relationships between an image 300A where concentration unevenness 308 is not visible and the inkjet head 200 (head unit 56).

In the image 300 shown in FIG. 13, the ninth inkjet head 200-9 is an inkjet head that forms the high concentration region 302 and the low concentration region 304, and the boundary position 310 is at the center of the inkjet head 200-9 in the X direction. The distance $X_1$ in the X direction from the boundary position 310 to the low concentration region end 312 of the inkjet head 200-9 is equal to or larger than the wavelength λ of the concentration unevenness 308.

The image 300 shown in FIG. 13 has a length in the X direction of $X_2$. The length of the left margin of the paper P in the X direction is $X_3$. The length of the right margin in the X direction is $X_4$. For instance, if the length of the paper P in the X direction is 700 millimeters, $X_2$=600 millimeters and $X_3=X_4$=50 millimeters.

In the image 300 shown in FIG. 13, two periods of the concentration unevenness 308 are visible. Accordingly, the visibility of the concentration unevenness 308 can be reduced by moving the image 300 to the side of the low concentration region 304 in a range of the distance in the X direction that exceeds the wavelength λ of the concentration unevenness 308 and is less than 2×λ.

If the wavelength of the concentration unevenness 308 is 10 millimeters, the movement distance of the image in the X direction exceeds 10 millimeters and is less than 20 millimeters (e.g., 15 millimeters).

The position of the image 300A shown in FIG. 14 in the X direction is adjusted to the side of the low concentration region end 312 (the right direction in FIG. 14) with respect to the image 300 in FIG. 13. The distance $X_{11}$ in the X direction from the boundary position 310A to the low concentration region end 312 of the inkjet head 200-9 is less than the wavelength λ of the concentration unevenness 308 (see FIG. 13).

The left margin $X_{31}$ of the paper P on which the image 300A is formed has a value acquired by adding a movement distance ($X_1$-$X_{11}$) of the image 300 in the X direction to the left margin $X_3$ shown in FIG. 13. The right margin $X_{41}$ has a value acquired by subtracting the movement distance ($X_1$-$X_{11}$) of the image 300 in the X direction from the right margin $X_4$ shown in FIG. 13.

In order to adjust the position of the image in the X direction, in the image processing (an example of the adjustment step) by the image forming controller 118 (an example of the adjustment device) in FIG. 2, the correspondence relationship between the nozzles 281 (see FIG. 5) and dots may be changed, or the pixel positions in the input image data may be adjusted (an example of the adjustment step) and then image processing may be applied.

According to the image forming method according to the first embodiment, adjustment of the position of the image 300 in the X direction (examples of the adjustment device and the adjustment step), in turn, adjusts the relative positional relationship between the image 300 and the inkjet head 200-9. Accordingly, the image 300A, where the visibility of the concentration unevenness 308 on the image 300 (concentration boundary region 307A) is reduced using the image processing technique, can be formed.

Second Embodiment

Figure 15:
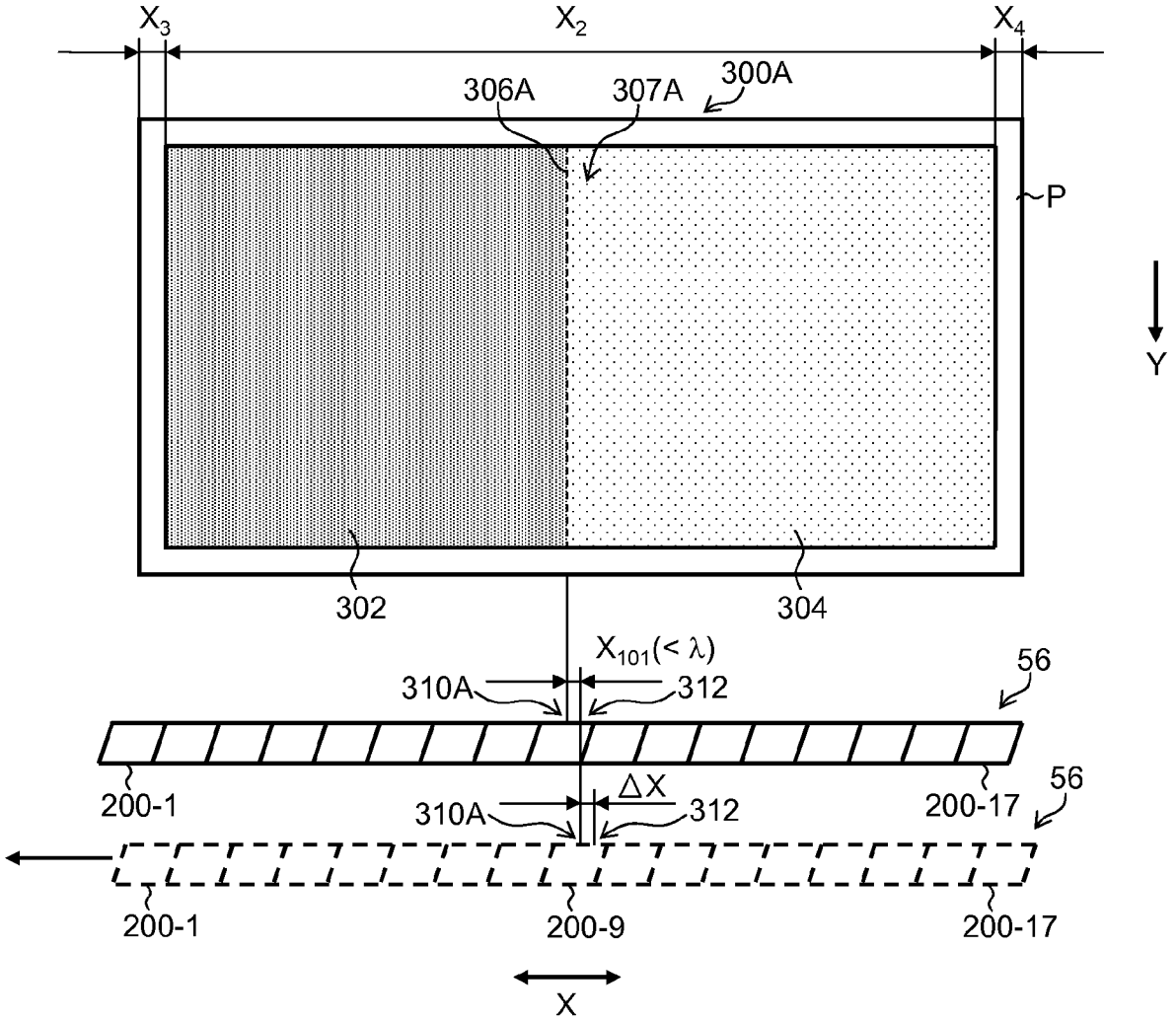
FIG. 15 is a diagram illustrating an image forming method according to a second embodiment.

Next, referring to FIG. 15, an image forming method according to a second embodiment is described. FIG. 15 is a diagram illustrating an image forming method according to the second embodiment. In FIG. 15, identical numerals are assigned to elements identical or similar to the elements in FIGS. 13 and 14. The description thereof is omitted.

As with the first embodiment described above, the second embodiment described below includes an inkjet head 200-9 that is an inkjet head for forming the high concentration region 302 and the low concentration region 304, and, in an image formed by the inkjet head 200-9, concentration unevenness 308 (see FIG. 13) occurs.

The image forming method according to the second embodiment moves the head unit 56 in the X direction, and adjusts the relative positional relationship between the image and the inkjet head (examples of the adjustment device and the adjustment step). As a result, the distance $X_{101}$ in the X direction from the boundary position 310A to the low concentration region end 312 of the inkjet head 200-9 is less than the wavelength λ of the concentration unevenness 308.

The head unit 56 shown in FIG. 15 using broken lines is in a state before being moved in the X direction. The head unit 56 shown using solid lines is in a state of having been moved along the X direction to a high concentration side (indicated by an arrow) by ΔX.

A configuration example in which the head unit 56 is moved in the X direction may be a configuration that includes a movement mechanism (a ball screw, a linear guide, etc.), a drive source for operating the movement mechanism (a motor, an actuator, etc.), and a driver (control circuit) for operating the drive source.

Instead of moving the head unit 56, the head unit 56 may be fixed, and the conveyance path of the paper P (the image formation drum 52 in FIG. 1) may be moved in the X direction.

The image forming method according to the second embodiment can reduce the visibility of the concentration unevenness 308 in the image 300 (concentration boundary region 307A) using the mechanical configuration, without executing an image processing that changes the position of the image 300A on the paper P.

Third Embodiment

Next, referring to FIGS. 16 to 19, an image processing method according to a third embodiment is described. The third embodiment described below reduces the visibility of the concentration unevenness by reducing (or enlarging) an image (examples of the adjustment device and the adjustment step).

Figure 16:
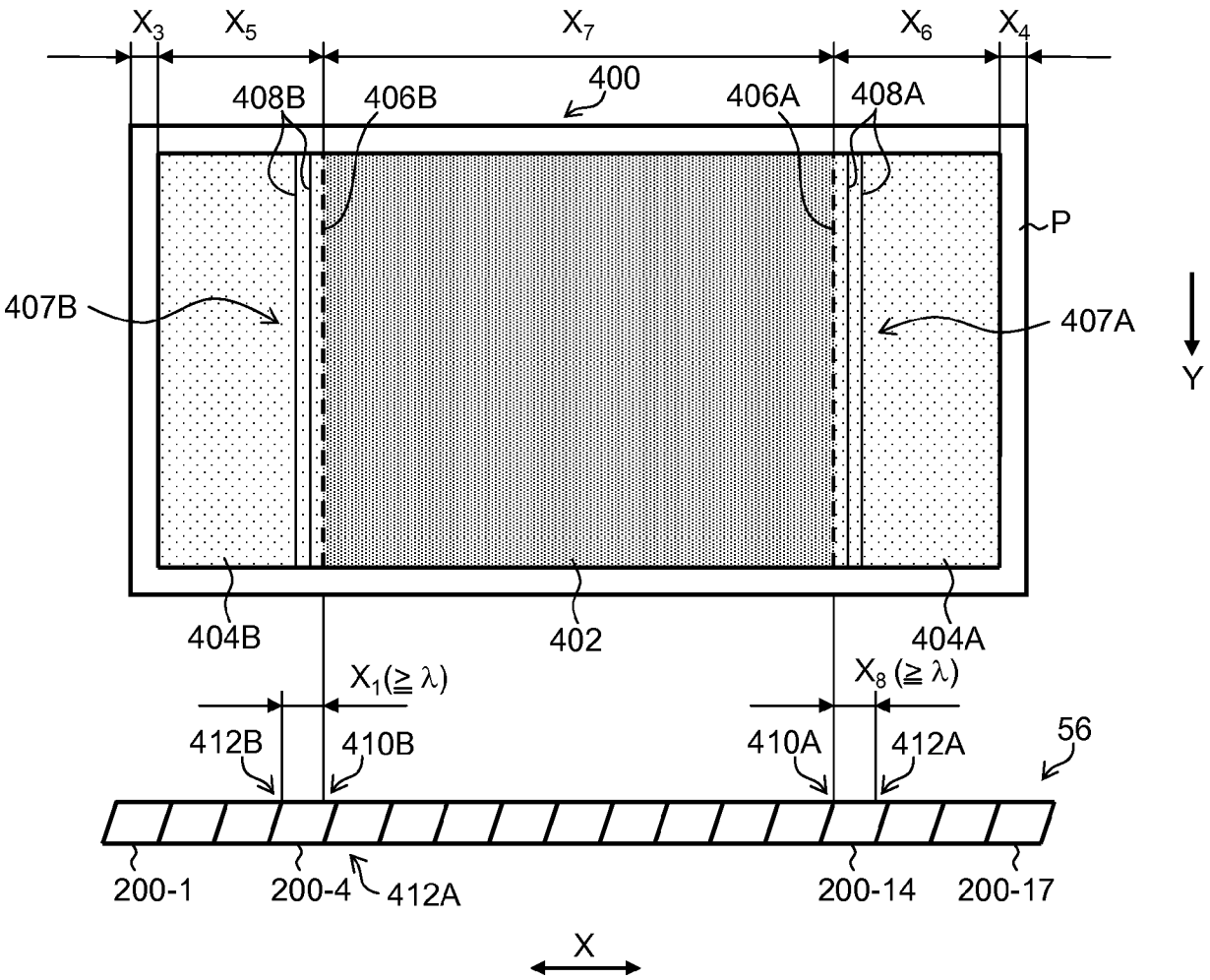
FIG. 16 is a diagram illustrating relative positions between an image where concentration unevenness is visible and an inkjet head (diagram illustrating a third embodiment)
Figure 17:
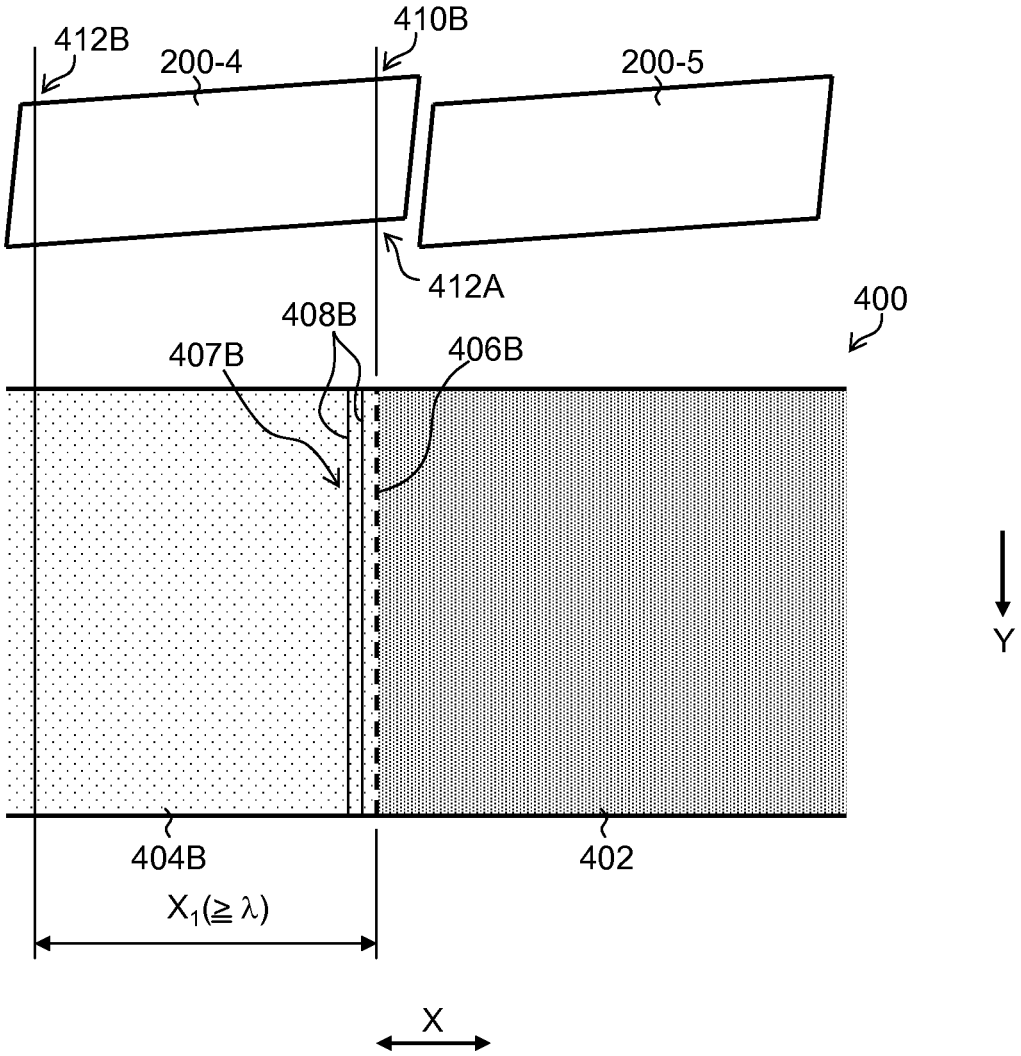
FIG. 17 is a partially enlarged diagram of FIG. 16.

FIG. 16 is a diagram illustrating relative positional relationships between an image 400 where concentration unevenness 408 is visible in concentration boundary regions 407A and 407B and an inkjet head 200 (head unit 56). FIG. 17 is a partially enlarged diagram where a part of FIG. 16 is extracted and enlarged.

Figure 18:
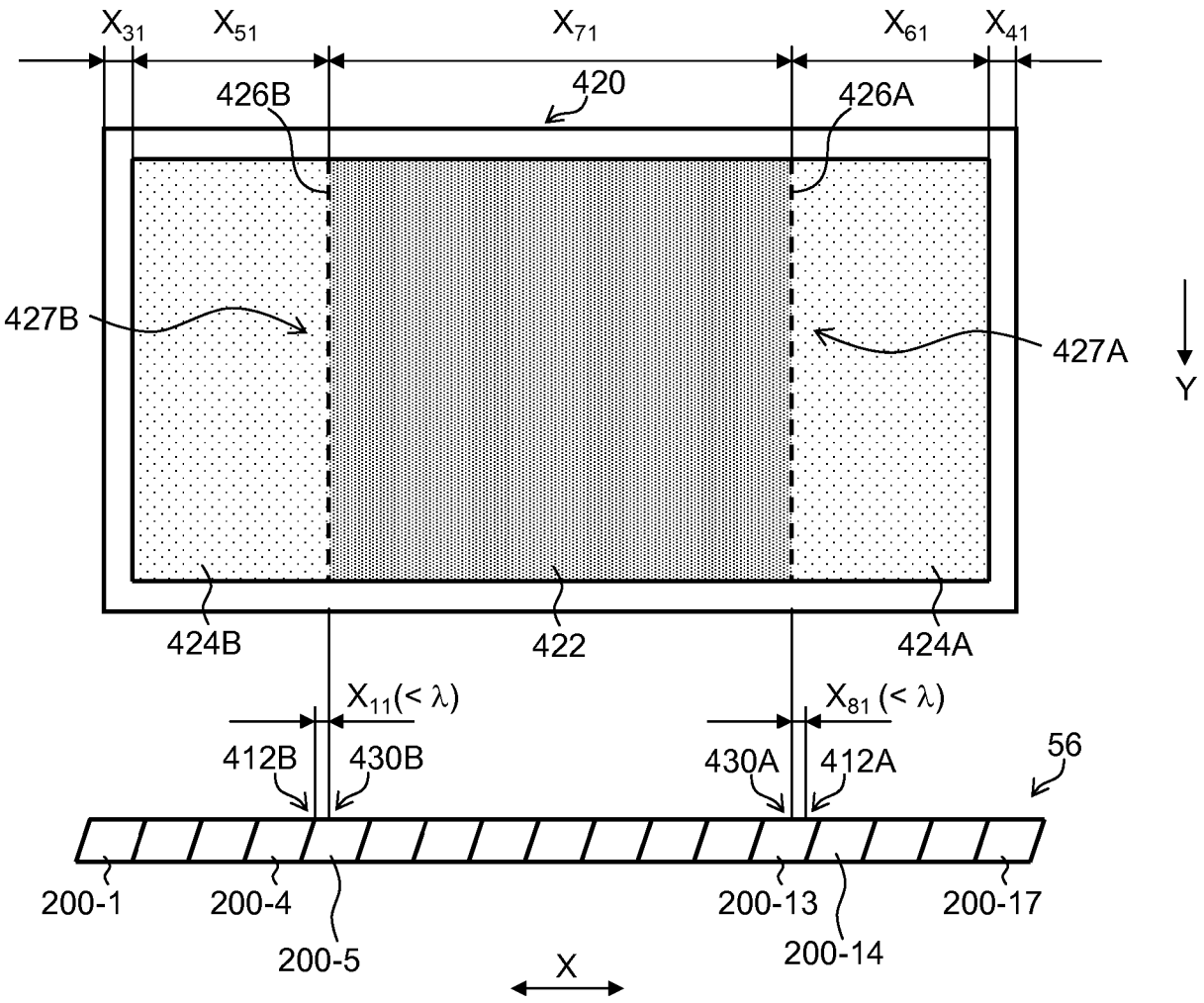
FIG. 18 is a diagram illustrating relative positions between an image where concentration unevenness is not visible and the inkjet head (diagram illustrating the third embodiment)
Figure 19:
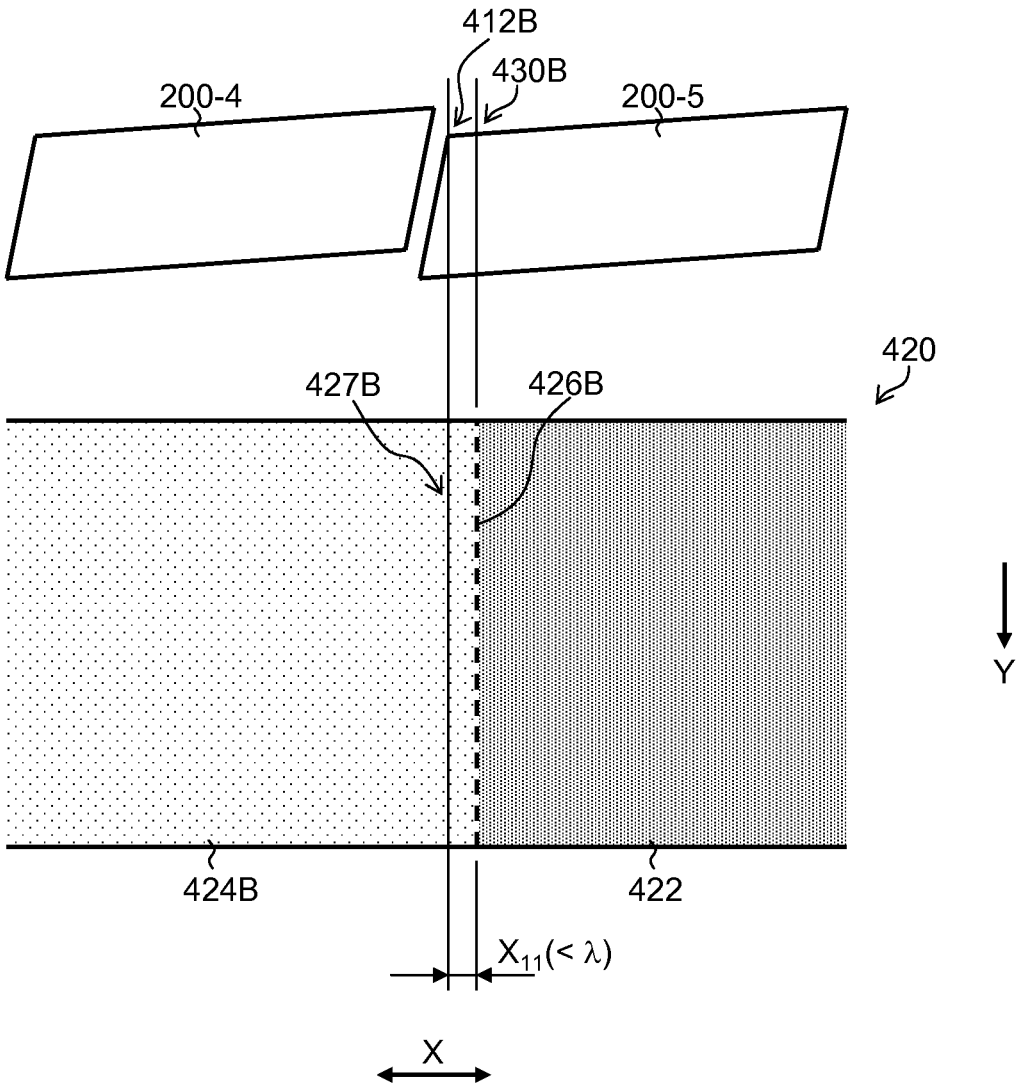
FIG. 19 is a partially enlarged diagram of FIG. 18.

FIG. 18 is a diagram illustrating the relative positional relationship between an image 420 where the visibility of the concentration unevenness 408 in the concentration boundary regions 407A and 407B in FIG. 16 is reduced and the inkjet head 200 (head unit 56). FIG. 19 is a partially enlarged diagram where a part of FIG. 18 is extracted and shown.

On the image 400 shown in FIG. 16, a first low concentration region 404A and a second low concentration region 404B are arranged on both sides of the high concentration region 402 in the X direction. In the first low concentration region 404A on the side with higher head numbers (right side in this diagram), concentration unevenness 408A occurs in the first concentration boundary region 407A. Also in the second low concentration region 404B on the side with lower head numbers (left side in this diagram), a concentration unevenness 408B occurs in the second concentration boundary region 407B that is a boundary with the high concentration region 402.

For formation of the image 400 shown in FIGS. 16 and 17, the fourth inkjet head 200-4 of the head unit 56 forms the high concentration region 402 and the second low concentration region 404B, and the fourteenth inkjet head 200-14 forms the high concentration region 402 and the first low concentration region 404A.

The image 400 has the length $X_6$ of the first low concentration region 404A in the X direction=the length $X_5$ of the second low concentration region 404B in the X direction=120 millimeters, and the length $X_7$ of the high concentration region 402 in the X direction=360 millimeters. The center position of the paper P in the X direction matches with the center position of the image 400 (high concentration region 402) in the X direction.

The length of the paper P in the X direction=700 millimeters, the length $X_3$ of the left margin in the X direction=the length $X_4$ of the right margin in the X direction=50 millimeters, and the length of the overlapping nozzles 201 of each inkjet head 200 (see FIG. 11) in the X direction is 2 millimeters. The length of each inkjet head 200 in the X direction is sufficiently long in comparison with the length of the overlapping nozzles 201 of each inkjet head 200 in the X direction, and the wavelengths λ of the concentration unevenness 408A and 408B.

FIG. 17 is a diagram where the inkjet heads 200-4 and 200-5 are extracted from the head unit 56 shown in FIG. 16, a part of the image 400 formed by the inkjet heads 200-4 and 200-5 is extracted, and the extractions are enlarged.

As shown in this diagram, in consideration of the total length of the inkjet head 200 in the X direction being sufficiently long in comparison with the length in the direction of the overlapping nozzles 201 (see FIG. 11), the distance $X_i$ in the X direction from the second boundary position 410B of the inkjet head 200-4 corresponding to the second concentration boundary 406B on the image 400 to the low concentration region end 412B of the inkjet head 200-4 is at least the wavelength λ (=10 millimeters) of the concentration unevenness 408B.

Although illustration is omitted, the distance $X_8$ in the X direction from the first boundary position 410A of the inkjet head 200-14 corresponding to the first concentration boundary 406A of the image 400 to the low concentration region end 412A of the inkjet head 200-4 is at least the wavelength λ (=10 millimeters) of the concentration unevenness 408A.

Accordingly, for the sake of reducing the visibility of the concentration unevenness 408A and 408B, it is required to adjust the relative positional relationship between the image 400 and the inkjet heads 200-4 and 200-14 and reduce the visibility of the concentration unevenness 408A and 408B.

Movement of the image 400 shown in FIGS. 16 and 17 to the side with low head numbers (the left direction in FIGS. 16 and 17) allows the second boundary position 410B of the inkjet head 200-4 to approach the low concentration region end 412B, and can satisfy $X_1<\lambda$. for the inkjet head 200-4.

Unfortunately, there may be a case where the first boundary position 410A of the inkjet head 200-14 is apart from the low concentration region end 412A, and X8<λ cannot be satisfied for the inkjet head 200-14.

Likewise, there may be a case where even if movement of the image 400 shown in FIGS. 16 and 17 to the side with high head numbers (the right direction in FIGS. 16 and 17) can satisfy $X_8<\lambda$ for the inkjet head 200-14, the movement cannot satisfy $X_1<\lambda$ for the inkjet head 200-4.

To address this problem, the image forming method according to the third embodiment reduces or enlarges the image 400 shown in FIGS. 16 and 17, forms the image 420 that is shown in FIGS. 18 and 19 and satisfies a condition "the distance from the boundary position of the inkjet head corresponding to the concentration boundary on the image to the low concentration region end is less than the wavelength of the concentration unevenness", and reduces the visibility of the concentration unevenness 408A and 408B.

In the following description, an example of forming the image 420 shown in FIGS. 18 and 19 by reduction by two percent without changing the center position of the image 400 shown in FIGS. 16 and 17 in the X direction is described.

Note that the image 420 shown in FIGS. 18 and 19 is a schematic diagram in every respect, and is not illustration of the image 400 shown in FIGS. 16 and 17 by precise reduction by two percent.

Reduction of the image 400 shown in FIGS. 16 and 17 by two percent moves the first boundary position 410A toward the high concentration region 402 by 3.6 millimeters, and moves the second boundary position 410B toward the high concentration region 402 by 3.6 millimeters.

The lengths of the overlapping nozzles 201 in the X direction are two millimeters. If the first boundary position 410A of the inkjet head 200-14 shown in FIGS. 16 and 17 is moved toward the high concentration region 402 by 3.6 millimeters, the position to which numeral 430A is assigned in FIGS. 18 and 19 becomes the first boundary position of the inkjet head 200-13.

Likewise, when the second boundary position 410B of the inkjet head 200-4 shown in FIGS. 16 and 17 is moved toward the high concentration region 402 by 3.6 millimeters, the position to which numeral 430B is assigned in FIGS. 18 and 19 becomes the second boundary position of the inkjet head 200-5.

Then, on the image 420 shown in FIGS. 18 and 19, the high concentration region 402 and the first low concentration region 404A are formed by the inkjet head 200-13, and the high concentration region 402 and the second low concentration region 404B are formed by the inkjet head 200-5.

In other words, the first boundary position 430A is moved to the inkjet head 200-13, and the inkjet head that forms the high concentration region 402 and the first low concentration region 404A is changed to the inkjet head 200-13, which is nearer to the center by one.

Likewise, the second boundary position 430B is moved to the inkjet head 200-5, and the inkjet head that forms the high concentration region 402 and the second low concentration region 404B is changed to inkjet head 200-5, which is nearer to the center by one.

As shown in FIG. 19, the distance $X_{11}$ from the second boundary position 430B of the inkjet head 200-5 corresponding to the second concentration boundary 426B on the image 420 to the low concentration region end 412B is 1.6 millimeters (=3.6 millimeters -2 millimeters), which is less than the wavelength λ (=10 millimeters) of the concentration unevenness 408B shown in FIGS. 16 and 17.

Likewise, the distance $X_{81}$ from the first boundary position 430A of the inkjet head 200-13 corresponding to the first concentration boundary 426A on the image 420 to the low concentration region end 412A is 1.6 millimeters, which is less than the wavelength λ (=10 millimeters) of the concentration unevenness 408A shown in FIGS. 16 and 17. Accordingly, in the first concentration boundary region 427A and the second concentration boundary region 427B, no concentration unevenness is visible.

In the image 420 shown in FIG. 18, the length $X_{61}$ of the first low concentration region 424A in the X direction=the length $X_{51}$ of the second low concentration region 424B in the X direction=117.6 millimeters (=120 millimeters x 0.98), and the length $X_{71}$ of the high concentration region 422 in the X direction=352.8 millimeters (=360 millimeters x 0.98).

The length $X_{31}$ of the left margin in the X direction=the length $X_{41}$ of the right margin in the X direction=56 millimeters (=(50 millimeters+600 millimeters x 0.02)/2). The center position of the paper P in the X direction matches with the center position of the image 420 (high concentration region 422) in the X direction.

This embodiment has exemplified the case of reducing the image. Alternatively, the image may be enlarged. For instance, a case may be exemplified where the concentration boundary is intended to be moved outward in the X direction (the boundary position being moved toward both ends of the head unit).

In the case of an image having at least three concentration boundary positions, the reduction ratio or the enlargement ratio may be appropriately changed, and the reduction ratio or the enlargement ratio by which concentration unevenness is most difficult to be viewed may be adopted.

Furthermore, the first embodiment, the second embodiment and the third embodiment may be appropriately combined, and the changing parameter (the amount of movement, the reduction ratio, the enlargement ratio, etc.) by which concentration unevenness is most difficult to be viewed may be adopted.

[Description of Flowchart]

Figure 20:
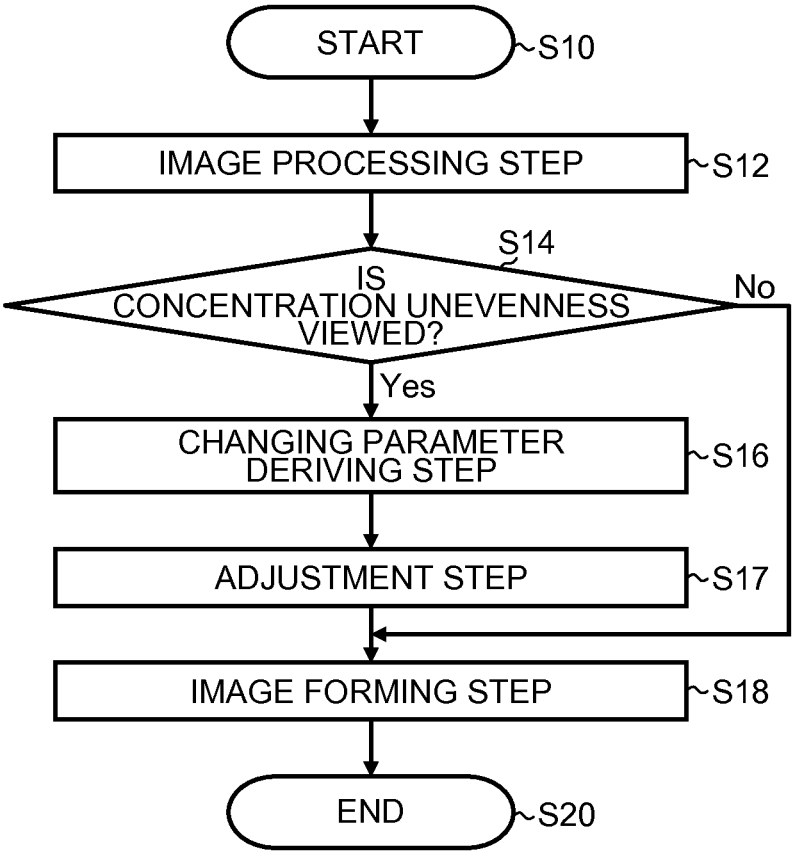
FIG. 20 is a flowchart of an image forming method according to the first to third embodiments.

FIG. 20 is a flowchart of the image forming method according to the first, second and third embodiments. After the image forming method is started (step S10), an image processing step is executed (step S12).

In step S12 that is the image processing step, input image data (e.g., raster data represented by a digital concentration value from 0 to 255) is acquired, a color changing process, a color separation (separation) process, a concentration unevenness correction process, and a halftone process are executed, and dot data (dot information on each pixel or on each color) is formed.

The processing proceeds to step S14, and concentration unevenness information that represents whether linear concentration unevenness is visible or not in the concentration boundary region in the low concentration region is acquired (the concentration unevenness information acquisition step).

If the concentration unevenness information representing that the concentration unevenness is not visible is acquired (No determination) in step S14, the processing proceeds to step S18 and image formation is executed (step S18). In contrast, if the concentration unevenness information representing that the concentration unevenness is visible is acquired (Yes determination) in step S14, the processing proceeds to step S16.

In step S16 that is a changing parameter deriving step (an example of the adjustment step), the wavelength λ of the concentration unevenness is derived (measured, read), the amount of movement of the image or the inkjet head, or a changing parameter, such as the reduction ratio (enlargement ratio) of the image is derived. The changing parameter is derived in step S16 and stored in association with the type of the image (image name, image number, etc.), thereby allowing the stored changing parameter to be used in the case of forming the same type of image.

Furthermore, an aspect that associates the image forming conditions (temperature, humidity, ink type, paper type, etc.) with the changing parameter and stores this changing parameter is preferable. An example of a device that stores the changing parameter may be the parameter memory unit 134 in FIG. 2.

After the changing parameter is derived in step S16, the processing proceeds to step S17 that is an adjustment step, and correspondence relationship (dot data) between the dots (pixels) and the nozzles are changed on the basis of the derived changing parameter (dot data changing step, an example of the adjustment step), or the position of the inkjet head or the paper P in the X direction on the conveyance path is changed (an inkjet head movement step, an example of the adjustment step), and then image formation is executed on the basis of the changed dot information and the like (step S18).

Also for an image having multiple positions where concentration unevenness is visible, the changing parameter by which concentration unevenness is most difficult to be viewed can be derived by adding a step of forming a test image after step S16 that is the changing parameter deriving step and reconfirming whether concentration unevenness is visible in the test image or not.

In step S18 that is the image forming step, it is monitored whether the number of formed images reaches a preset setting value or not. If the number of formed images reaches the setting value, the image forming method is finished (step S20).

The aforementioned image forming method can be stored as a program in a storing medium that cannot be temporarily rewritten.

[Description of Working-Effects]

According to the image forming apparatus and the image forming method that are configured as described above, during formation of the image including the high concentration region and the low concentration region, the relative positional relationship between the inkjet head and the image is changed, the distance from the boundary position of the inkjet head that forms the high concentration region and the low concentration region corresponding to the concentration boundary between the high concentration region and the low concentration region to the low concentration region end of the inkjet head satisfies a condition of being less than the wavelength λ of the concentration unevenness, thereby allowing the visibility of the concentration unevenness occurring in the concentration boundary region in the low concentration region to be reduced.

An aspect that changes the relative positional relationship between an inkjet head and an image may be an aspect that changes the relative positions between the image and the inkjet head, and an aspect that reduces or enlarges the image. Furthermore, the aspect that changes the relative positions between the image and the inkjet head may be an aspect that shifts the image (the correspondence relationship between dots (pixels) and nozzles is changed), and an aspect that mechanically moves the conveyance path of the inkjet head or the paper P.

Furthermore, the aspect that changes the relative positions between the image and the inkjet head may be combined with the aspect that reduces or enlarges the image.

[Case of Concentration Boundary Being at Overlapping Nozzles]

Figure 21:
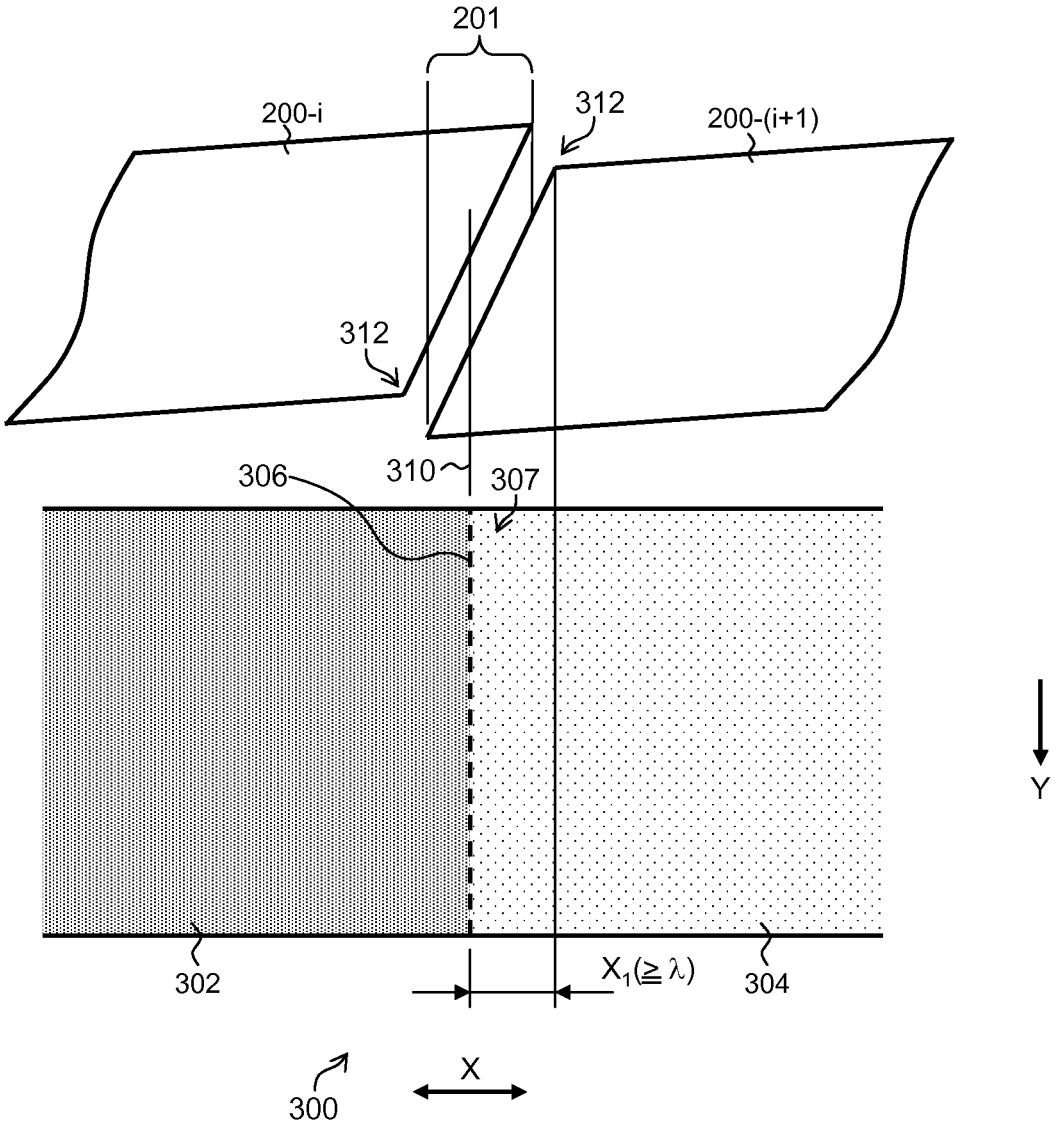
FIG. 21 is a diagram illustrating a case where the boundary between a high concentration region and a low concentration region is positioned at the overlapping nozzles.

Next, referring to FIG. 21, the case where the boundary position 310 corresponding to the concentration boundary 306 between the high concentration region 302 and the low concentration region 304 is positioned at the overlapping nozzles 201 is described. In FIG. 21, the identical numerals are assigned to elements identical or similar to the elements in FIG. 9. The description thereof is omitted.

As shown in FIG. 21, if the boundary position 310 of the inkjet head 200-*i* corresponding to the concentration boundary 306 between the high concentration region 302 and the low concentration region 304 is positioned in the overlapping nozzles 201 of the inkjet head 200-*i* (inkjet head 200-(i+1)), concentration unevenness (e.g., concentration unevenness 408 in FIG. 9) that may be visible in the concentration boundary region 307 in the low concentration region 304 is considered not to occur.

The reason is as follows. In the overlapping nozzles 201, the nozzles 281 (see FIG. 6) belonging to the inkjet head 200-*i* and the nozzles 281 belonging to the inkjet head 200-(i+1) are mixed.

As described above, the inkjet head 200-*i* and the inkjet head 200-(i+1) are mechanically separated from each other. Accordingly, vibrations of the piezoelectric element 230 (see FIG. 6) corresponding to the nozzle 281 that forms the high concentration region 302 of the inkjet head 200-*i* are considered not to be propagated to the piezoelectric element 230 corresponding to the nozzle 281 belonging to the inkjet head 200-(i+1).

Meanwhile, vibrations of the piezoelectric elements 230 corresponding to the nozzles 281 that form the high concentration region 302 of the inkjet head 200-*i* affect the piezoelectric elements 230 corresponding to the nozzles 281 that form the low concentration region 304 of the inkjet head 200-*i*. However, the number of nozzles 281 belonging to the inkjet head 200-*i* among the overlapping nozzles 201 is half the total number of nozzles 281 among the overlapping nozzles 201. In image formation by the overlapping nozzles 201, the piezoelectric elements 230 (nozzles 281) affected by vibrations of the piezoelectric elements 230 corresponding to the nozzles 281 that form the high concentration region 302 of the inkjet head 200-*i* are limited. Adverse effects on the overlapping nozzles 201 by vibrations of the piezoelectric elements 230 that correspond to the nozzles 281 that form the high concentration region 302 of the inkjet head 200-*i* are considered weak.

Accordingly, if the boundary position 310 of the inkjet head 200-*i* is in the overlapping nozzles 201, concentration unevenness that may be visible due to vibrations of the piezoelectric element 230 corresponding to the nozzles 281 that form the high concentration region 302 of the inkjet head 200-*i* is considered not to occur.

Application Example

Next, application examples of the aforementioned image forming apparatus and the image forming method are described.

<Case of Pieces of Concentration Unevenness being Visible>

Figure 22:
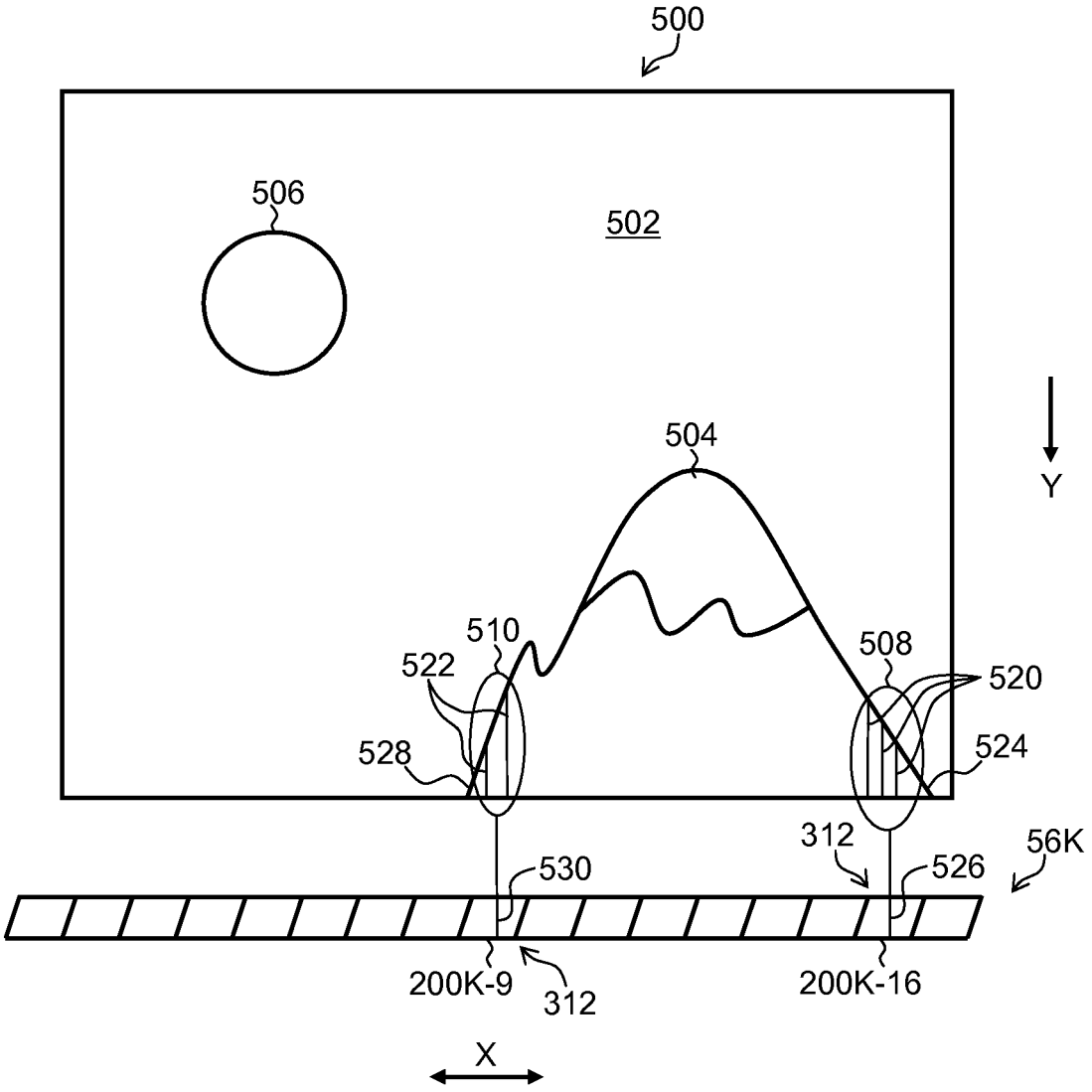
FIG. 22 is a schematic diagram showing a relationship between an inkjet head to which an image forming method according to an application example of the present invention has not been applied yet and an image.
Figure 23:
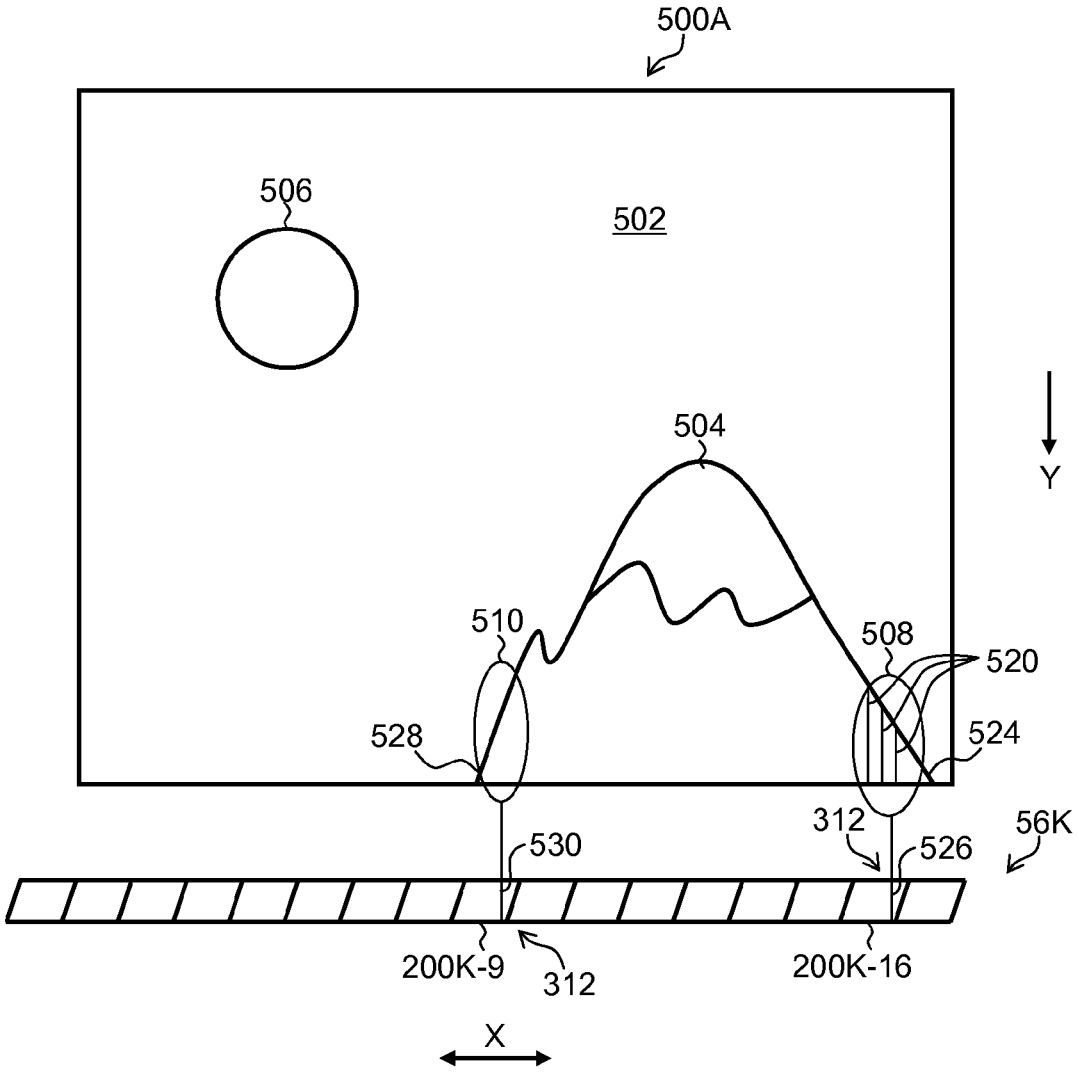
FIG. 23 is a schematic diagram showing a relationship between an inkjet head to which the image forming method according to the application example of the present invention has been applied and an image.

FIGS. 22 and 23 are diagrams illustrating an application example of the present invention. FIG. 22 is a schematic diagram showing a relationship between an inkjet head to which an image forming method according to the application example of the present invention has not been applied yet and an image. FIG. 23 is a schematic diagram showing a relationship between the inkjet head to which the image forming method according to the application example of the present invention has been applied and the image.

Note that since the configuration having been described is applied to the head unit 56 and the inkjet head 200 shown in FIGS. 22 and 23, the detailed description is omitted here.

An image 500 shown in FIG. 22 and an image 500A shown in FIG. 23 are formed using at least the head unit 56K (see FIG. 1) for K ink and the head unit 56Y for Y ink forming a second object 506. However, FIGS. 22 and 23 show only the head unit 56K for the K ink, and illustration of head units for the other colors is omitted.

The image 500 shown in FIG. 22 schematically shows a photograph image taken including a mountain (a gray first object to which numeral 504 is assigned) and a moon (a yellow second object to which numeral 506 is assigned) at nighttime (black background to which numeral 502 is assigned).

On the image 500, concentration unevenness 520 which is visible in a first region 508 exists, and concentration unevenness 522 which is visible in a second region 510 exists.

In the background 502, the print rate of K ink is 100 percent. In a region of the first object 504 to which numeral 508 is assigned, the print rate of K ink is 30 percent. In a region of the first object 504 to which numeral 510 is assigned, the print rate of K ink is 15 percent. In the second object 506, the print rate of K ink is zero percent (Y ink is used but K ink is not used).

The "print rate" is an area covered by ink (dots) per unit area. The relatively higher the print rate is, the relatively higher the concentration value is. The relatively lower the print rate is, the relatively lower the concentration value is.

Furthermore, the relatively higher the print rate is, the relatively lower the brightness is. The relatively lower the print rate is, the relatively higher the brightness is. Note that the print rate is not a numeric value that limits the high concentration region and the low concentration region, but is an example in every respect. On the image where concentration unevenness is visible, a region with a relatively high print rate is a "high concentration region", and a region with a relatively low print rate is a "low concentration region".

The concentration unevenness 520 in the region 508 occurs in the background 502 (corresponding to the high concentration region 302 in FIG. 9) and a part formed by using an inkjet head 200K-16 that forms the first object 504 (corresponding to the low concentration region 304 in FIG. 9).

The concentration boundary 524 between the background 502 and the first object 504 continuously varies in the X direction. Accordingly, as shown in FIG. 12, the center position of the concentration boundary 524 in the X direction is regarded as the representative position of the concentration boundary 524.

The boundary position 526 of the inkjet head 200K-16 corresponding to the concentration boundary 524 (the representative position of the concentration boundary 524) is the center position of the inkjet head 200K-16 in the X direction.

The concentration unevenness 522 in the region 510 occurs in the background 502 (corresponding to the high concentration region 302 in FIG. 9), and in a part formed by using the inkjet head 200K-9 that forms the first object 504 (corresponding to the low concentration region 304 in FIG. 9).

The concentration boundary 528 between the background 502 and the first object 504 continuously varies in the X direction. Accordingly, as shown in FIG. 12, the center position of the concentration boundary 528 in the X direction is regarded as the representative position of the concentration boundary 528.

The boundary position 530 of the inkjet head 200K-9 corresponding to the concentration boundary 528 (the representative position of the concentration boundary) is the center position of the inkjet head 200K-9 in the X direction.

For instance, if the aspect of moving the relative positions between the image 500 and the inkjet heads 200K-9 and 200K-16 (head unit 56) in the X direction that is shown in the first and second embodiments is applied in order to reduce the concentration unevenness 520 and 522 on the image 500, it is difficult to reduce the visibility of any piece of the concentration unevenness 520 and 522.

The aspect of reducing (enlarging) the image shown in the third embodiment has an upper limit of the reduction ratio (enlargement ratio). Accordingly, application to the image 500 shown in FIG. 22 is difficult.

To address this problem, the visibility of the concentration unevenness 520 and the visibility of the concentration unevenness 522 are compared with each other, and a process of reducing the visibility is applied only to the concentration unevenness that is relatively visible, thereby reducing the visibility of the concentration unevenness over the entire image as a whole.

According to comparison between the concentration unevenness 520 in the region 508 and the concentration unevenness 522 in the region 510, the concentration unevenness 522 in the region 510 that has a relatively high difference in print rate of K is more visible than the concentration unevenness 520 in the region 508 that has a relatively low difference in print rate of K.

Then, priority is put on reduction in visibility of the concentration unevenness 522 in the region 510, and the relative positional relationship between the inkjet head 200K-9 and the image 500 is adjusted. That is, as shown in FIG. 23, the distance in the X direction from the boundary position 530A of the inkjet head 200K-9 to the low concentration region end 312 is less than the wavelength λ of the concentration unevenness 522.

The image 500A shown in FIG. 23 is an image where the relative positional relationship between the inkjet head 200K-9 and the image 500 shown in FIG. 22 is adjusted, and the concentration unevenness 522 in the region 510 shown in FIG. 22 is not visible.

Meanwhile, also on the image 500A, the concentration unevenness 520 in the region 508 is visible. However, the visibility of the concentration unevenness 522 in the region 510 shown in FIG. 22 is reduced. Accordingly, the visibility of the concentration unevenness on the entire image 500A can be reduced as a whole.

Figure 24:
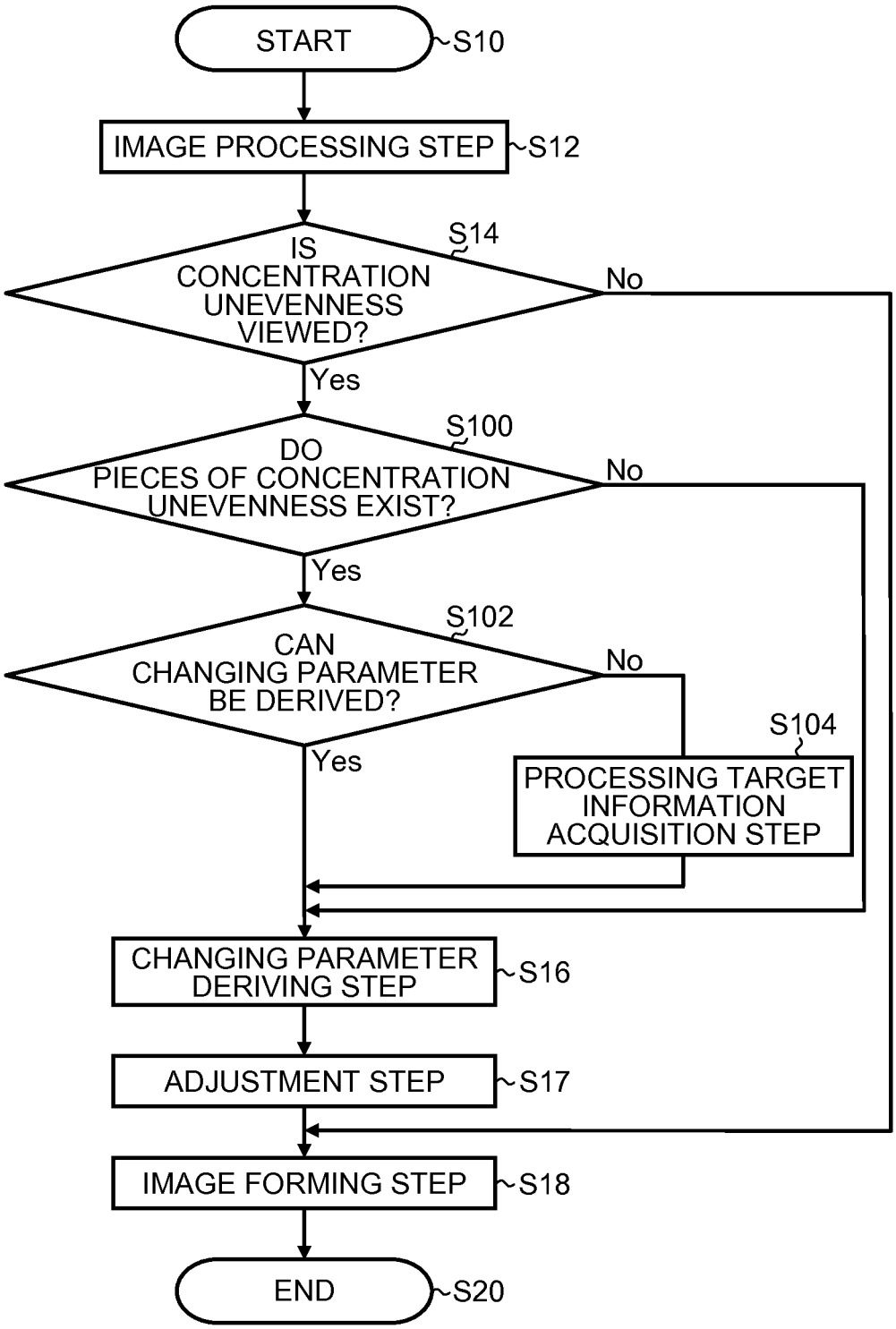
FIG. 24 is a flowchart of the image forming method according to the application example of the present invention.

FIG. 24 is a flowchart showing the flow of the image forming method according to the application example of the present invention. In the flowchart shown in FIG. 24, step S100 (a second concentration unevenness information acquisition step), step S102 (a third concentration unevenness information acquisition step) and step S104 (processing target determination step) are added between step S14 (a first concentration unevenness information acquisition step), and step S16 (changing parameter deriving step) in the flowchart shown in FIG. 20.

That is, in step S14 that is the first concentration unevenness information acquisition step, if concentration unevenness information indicating that concentration unevenness is visible is acquired (Yes determination), the processing proceeds to step S100 (the second concentration unevenness information acquisition step), and information indicating whether the region where concentration unevenness is visible is only one or more is acquired.

In step S100 that is a second concentration unevenness information acquisition step, if concentration unevenness information indicating that the region where concentration unevenness is visible is only one is acquired (No determination), the processing proceeds to step S16 and the changing parameter is derived. On the contrary, in step S100 that is a second concentration unevenness information acquisition step, if concentration unevenness information indicating that in multiple regions the concentration unevenness is visible is acquired (Yes determination), the processing proceeds to step S102 (a third concentration unevenness information acquisition step), and it is determined whether the changing parameters corresponding to the multiple regions (concentration unevenness) can be derived or not.

If it is determined that the changing parameter cannot be derived in step S102 that is the third concentration unevenness information acquisition step (No determination), the processing proceeds to step S104 (processing target information acquisition step), and information on one or more processing target regions is acquired from among the multiple processing target region candidates.

In step S104 that is the processing target information acquisition step, information that a region where the most visible concentration unevenness exists is regarded as the processing target among processing target candidates is acquired.

On the image 500 shown in FIG. 22, the difference between print rates of the high concentration region (print rate of K of 100 percent) and the low concentration region (print rate of K of 15 percent) in the region 510 is larger than the difference between the print rates of the high concentration region (print rate of K of 100 percent) and the low concentration region (print rate of K of 30 percent) in the region 508. Accordingly, processing target information that the concentration unevenness 522 in the region 510 is more visible than the concentration unevenness 520 in the region 508 and the region 510 (concentration unevenness 522) is regarded as the processing target is acquired.

After the processing target information is acquired in step S104 that is the processing target information acquisition step, the processing proceeds to step S16 (changing parameter deriving step) and the changing parameter is derived. The processes thereafter are identical to the processes in the flowchart shown in FIG. 20. Here, the description thereof is omitted.

The evaluation of the visibility of concentration unevenness may be optimized while an operator changes the changing parameter. Alternatively, an evaluation function that defines the relationship between the print rate and the conspicuity of concentration unevenness may be prepared in advance, and optimization may be performed while automatically changing the changing parameter in the apparatus.

For instance, the evaluation function that specifies, as in [Table 1], the relationship between the print rate and the conspicuity of the concentration unevenness in the low concentration region where it is provided that the print rate of the high concentration region is regarded as 100 percent is defined.

TABLE 1

| Print Rate (percent) in Low Concentration Region | 15 | 20 | 25 | 30 |
|---|---|---|---|---|
| Conspicuity of Concentration Unevenness | 10 | 8 | 6 | 4 |

The conspicuity of the concentration unevenness is represented by an integer varying from 0 to 10. If the numeric value is relatively high, the concentration unevenness is conspicuous (tends to be visible). Provided that integrated indicator S=Σ (conspicuity of concentration unevenness x region width), the visibility of the concentration unevenness can be determined on the basis of the integrated indicator S. The relatively higher the value of the integrated indicator S is, the more visible the concentration unevenness is. The relatively lower the value of the integrated indicator S, the more difficult the concentration unevenness is viewed.

The "region width" is the length of the occurrence region of the concentration unevenness in the X direction, and acquired by the wavelength λ of the concentration unevenness×the number of periods of visible concentration unevenness.

Provided that the region widths of concentration unevenness 520 and 522 on the image 500 shown in FIG. 22 are each 20 millimeters, the integrated indicator $S_1$ of the image 500 is $S_1=10\times20+4\times20=280$.

The image 500A shown in FIG. 23 is an image acquired by moving the image 500 shown in FIG. 22 by 20 millimeters. Provided that the region width of the concentration unevenness 520 on the image 500A is four millimeters, the integrated indicator $S_2$ of the image 500A is $S_2=10\times0+4\times4=16$.

Accordingly, it can be said that in comparison with the image 500 shown in FIG. 22, the image 500A shown in FIG. 23 has a reduced visibility of the concentration unevenness as a whole.

The visibility evaluation of the concentration unevenness through use of the aforementioned evaluation function and integrated indicator is applicable to concentration unevenness evaluation in the image forming method according to the first embodiment, the second embodiment, and the third embodiment.

In this example, the aspect that determines one piece of concentration unevenness (region) as the processing target has been exemplified. Alternatively, the processing target may include pieces of concentration unevenness (regions) where a common changing parameter can be derived.

In the image forming apparatus and the image forming method according to the aforementioned application example, if the visible concentration unevenness exists in the multiple regions and the common changing parameter for reducing the visibility of the concentration unevenness cannot be derived for the multiple regions, processing target information that the most visible concentration unevenness is regarded as the processing target among the multiple processing target candidates is acquired, and the changing parameter is derived for the processing target. Accordingly, the visibility of the concentration unevenness can be reduced over the entire image as a whole.

<Application to Color Image Formation>

Next, application to image formation through use of color ink other than K ink (Y ink, M ink, C ink, etc.) is described.

A "color image" is a multi-colored image in which not only the black (K) ink but also at least one color is used. For instance, the image may use cyan (C) ink, magenta (M) ink, and yellow (Y) ink.

On the image 500 shown in FIG. 22 and the image 500A shown in FIG. 23, the background 502 and the first object 504 are formed using K ink, and the second object 506 is formed using Y ink.

On a color image, the concentration unevenness of K ink is more visible than the concentration unevenness of the other ink. Accordingly, in the case where the K ink is used, attention is focused on the print rate of K ink, a region having a relatively high print rate of K ink is regarded as the "high concentration region", and a region having a relatively low print rate of K ink is regarded as "low concentration region".

In the aspect of "moving the image" according to the first embodiment and the aspect of "reducing (enlarging) the image" according to the third embodiment, the changing parameter of the inkjet head (head unit) of the K ink can be adopted as the changing parameter of the inkjet head of another color.

In the aspect of "moving the inkjet head" according to the second embodiment, color registration adjustment is executed. Accordingly, it is sufficient to derive only the changing parameter of the inkjet head for K ink. It is unnecessary to derive the changing parameters of the inkjet heads for the other colors.

If no concentration unevenness is visible in the image using K ink, it is sufficient to derive any one of changing parameters of the inkjet head for M ink and the inkjet head for C ink (the inkjet head for a color where concentration unevenness tends to be visible).

The aforementioned image forming apparatus and image forming method can be appropriately changed, added and deleted within a scope without departing the gist of the present invention. Furthermore, the aforementioned embodiments can be appropriately combined.

[Invention Disclosed in this Specification]

As grasped from the description of the embodiments of the present invention described above in detail, this specification includes disclosure of various types of technical thought including at least the following aspects.

(First Aspect) An image forming apparatus, including: an inkjet head which includes a plurality of nozzles arranged along a first direction; a concentration unevenness information acquisition device which, when forming an image including a first concentration region, and a second concentration region separated from the first concentration region by a concentration boundary and having a relatively lower concentration than the first concentration region has using the inkjet head, acquires concentration unevenness information on whether concentration unevenness is visible in a concentration boundary region in the second concentration region or not; and an adjustment device which, when the concentration unevenness information acquisition device acquires the concentration unevenness information representing that the concentration unevenness is visible, adjusts relative positions between the inkjet head and the image formed by the inkjet head to make a distance from a boundary position of the inkjet head in the first direction corresponding to a position of the concentration boundary in the first direction to a second concentration region end of the inkjet head in the first direction be less than a reciprocal of a spatial frequency of the concentration unevenness.

According to the first aspect, by making the distance from the boundary position of the inkjet head corresponding to the concentration boundary between the first concentration region and the second concentration region to the second concentration region end of the inkjet head be less than the reciprocal of the spatial frequency of the concentration unevenness, the length of the part in the first direction where the inkjet head forms the second concentration region is less than one period of the concentration unevenness. Even if crosstalk caused by vibrations of the part where the inkjet head forms the first concentration region occurs, the visibility of the concentration unevenness occurring in the second concentration region can be reduced.

A matrix arrangement where multiple nozzles are arranged is applicable to the inkjet head with respect to the row direction along the first direction and the column direction obliquely crossing the first direction.

An aspect that includes a relative movement device that relatively moves the inkjet head and a medium on which an image is formed along the second direction orthogonal to the first direction is preferable.

A full line type head that has the length corresponding to the entire width for the medium in the first direction is applicable to the inkjet head.

(Second Aspect) The image forming apparatus according to the first aspect, wherein the adjustment device adjusts a correspondence relationship between the nozzles and dots forming an image in the first direction.

According to the second aspect, an image processing can reduce the visibility of the concentration unevenness occurring in the concentration boundary region in the second concentration region.

An aspect that includes an image processing device that forms dot data representing dot information on each pixel from input image data is preferable. The image processing device can be used as the adjustment device in the second aspect.

(Third Aspect): The image forming apparatus according to the first aspect, wherein the adjustment device moves a conveyance path of the inkjet head or a medium on which an image is formed along the first direction.

According to the third aspect, mechanical movement of the conveyance path of the inkjet head or the medium along the first direction can reduce the visibility of the concentration unevenness occurring in the concentration boundary region in the second concentration region.

(Fourth Aspect): An image forming apparatus, including: an inkjet head which includes a plurality of nozzles arranged along a first direction; a concentration unevenness information acquisition device which, when forming an image including a first concentration region, and a second concentration region separated from the first concentration region by a concentration boundary and having a relatively lower concentration than the first concentration region has using the inkjet head, acquires concentration unevenness information on whether concentration unevenness is visible in a concentration boundary region in the second concentration region or not; and an adjustment device which, when the concentration unevenness information acquisition device acquires the concentration unevenness information representing that the concentration unevenness is visible, reduces or enlarges the image formed by the inkjet head to make a distance from a boundary position of the inkjet head in the first direction corresponding to a position of the concentration boundary in the first direction to a second concentration region end of the inkjet head in the first direction be less than a reciprocal of a spatial frequency of the concentration unevenness.

According to the fourth aspect, reduction or enlargement of the image within an extent that does not affect the entire image can reduce the visibility of the concentration unevenness occurring in the concentration boundary region in the second concentration region.

(Fifth Aspect): The image forming apparatus according to any one of the first aspect to the fourth aspect, wherein the concentration unevenness information acquisition device acquires the concentration unevenness information generated using an evaluation function which defines a relationship between a value acquired by subtracting a print rate in the second concentration region from a print rate represented by an area covered by ink in each unit area in the first concentration region or a value acquired by dividing a print rate in the first concentration region by the print rate in the second concentration region and visibility of concentration unevenness.

According to the fifth aspect, using the difference or ratio of print rates makes it possible to determine whether the concentration unevenness occurring in the second concentration region is visible or not.

(Sixth Aspect): The image forming apparatus according to any one of the first aspect to the fifth aspect, wherein if a concentration at the concentration boundary changes continuously or stepwise in the first direction, the concentration unevenness information acquisition device acquires the concentration unevenness information generated using a representative position of the concentration boundary, and the adjustment device performs a process while regarding a position in the first direction corresponding to the representative position as the boundary position.

According to the sixth aspect, even on the image varying the concentration boundary continuously or stepwise in the first direction, the visibility of the concentration unevenness occurring in the concentration boundary region in the second concentration region can be reduced.

(Seventh Aspect): The image forming apparatus according to any one of the first aspect to the sixth aspect, wherein when the concentration unevenness information acquisition device acquires the concentration unevenness information that the concentration unevenness is visible at a plurality of positions in an image, the adjustment device selects a most visible piece of concentration unevenness from among the pieces of concentration unevenness, and performs a process at a position of the image where the selected piece of concentration unevenness occurs.

According to the seventh aspect, on the image where the concentration unevenness which is visible at multiple positions occurs, application of a reduction process to the most visible concentration unevenness can reduce the visibility of the concentration unevenness over the entire image as a whole.

(Eighth Aspect): The image forming apparatus according to any one of the first aspect to the seventh aspect, wherein the inkjet head includes at least an inkjet head for black ink, the concentration unevenness information acquisition device acquires the concentration unevenness information in a region formed by the black ink, and in conformity with the adjustment related to the inkjet head for the black ink, the adjustment device performs adjustment related to an inkjet head for ink of another color.

According to the eighth aspect, on the color image including at least the part using black ink, the concentration unevenness of the part formed using the black ink is more visible than concentration unevenness of the part formed using ink of another color. Accordingly, application of a process of reducing the concentration unevenness to the part formed using black ink that tends to be visible can reduce the visibility of the concentration unevenness over the entire image as a whole. (Ninth Aspect): The image forming apparatus according to any one of the first aspect to the eighth aspect, further including a head unit which has a structure where a plurality of the inkjet heads are coupled together along the first direction.

According to the ninth aspect, in the image forming apparatus that includes the head unit having the structure where the plurality of inkjet heads are coupled together in the first direction, the visibility of the concentration unevenness caused by mechanical crosstalk can be reduced.

In the head unit, overlapping nozzles may be provided at the connection part of adjacent inkjet heads.

(Tenth Aspect): An image forming method, including: a concentration unevenness information acquisition step of, when forming an image including a first concentration region, and a second concentration region separated from the first concentration region by a concentration boundary and having a relatively lower concentration than the first concentration region has using an inkjet head in which a plurality of nozzles are arranged along a first direction, acquiring concentration unevenness information on whether concentration unevenness is visible in a concentration boundary region in the second concentration region or not; and an adjustment step of, when the concentration unevenness information acquisition step acquires the concentration unevenness information representing that the concentration unevenness is visible, adjusting relative positions between the inkjet head and the image formed by the inkjet head to make a distance from a boundary position of the inkjet head in the first direction corresponding to a position of the concentration boundary in the first direction to a second concentration region end of the inkjet head in the first direction be less than a reciprocal of a spatial frequency of the concentration unevenness.

According to the tenth aspect, an aspect where the adjustment step adjusts the correspondence relationship between the nozzles and the dots forming the image in the first direction is preferable.

In the tenth aspect, an aspect where the adjustment step moves the conveyance path of the inkjet head or the medium on which the image is formed along the first direction is preferable.

(Eleventh Aspect): An image forming method, including: a concentration unevenness information acquisition step of, when forming an image including a first concentration region, and a second concentration region separated from the first concentration region by a concentration boundary and having a relatively lower concentration than the first concentration region has using an inkjet head in which a plurality of nozzles are arranged along a first direction, acquiring concentration unevenness information on whether concentration unevenness is visible in a concentration boundary region in the second concentration region or not; and an adjustment step of, when the concentration unevenness information acquisition step acquires the concentration unevenness information representing that the concentration unevenness is visible, reducing or enlarging the image formed by the inkjet head to make a distance from a boundary position of the inkjet head in the first direction corresponding to a position of the concentration boundary in the first direction to a second concentration region end of the inkjet head in the first direction be less than a reciprocal of a spatial frequency of the concentration unevenness.

In the tenth aspect or the eleventh aspect, an aspect is preferable where the concentration unevenness information acquisition step acquires concentration unevenness information generated using an evaluation function defining a relationship between a value acquired by subtracting a print rate in the second concentration region from a print rate represented by an area covered by ink in each unit area in the first concentration region or a value acquired by dividing a print rate in the first concentration region by a print rate in the second concentration region and the visibility of concentration unevenness.

In the tenth aspect or the eleventh aspect, an aspect is preferable where if the concentration of the concentration boundary varies continuously or stepwise in the first direction, the concentration unevenness information acquisition step acquires the concentration unevenness information generated using the representative position of the concentration boundary, and the adjustment step performs a process while regarding the position corresponding to the representative position in the first direction as the boundary position.

In the tenth aspect or the eleventh aspect, an aspect is preferable where when the concentration unevenness information acquisition step acquires the concentration unevenness information that the concentration unevenness is visible at multiple positions on the image, the adjustment step selects the most visible concentration unevenness from among the multiple pieces of the concentration unevenness, and performs the process at the positions on the image where the selected piece of the concentration unevenness occurs.

In the tenth aspect or the eleventh aspect, an aspect is preferable where the inkjet head includes at least an inkjet head for black ink, the concentration unevenness information acquisition step acquires the concentration unevenness information in a region formed using the black ink, and in conformity with the adjustment related to the inkjet head for the black ink, the adjustment device performs adjustment related to an inkjet head for ink of another color.

What is claimed is:

1. An image forming apparatus, comprising:

an inkjet head which includes a plurality of nozzles arranged along a first direction;

a concentration unevenness information acquisition device which, when forming an image including a first concentration region, and a second concentration region separated from the first concentration region by a concentration boundary and having a relatively lower concentration than the first concentration region has using the inkjet head, acquires concentration unevenness information on whether concentration unevenness is visible in a concentration boundary region in the second concentration region or not; and an adjustment device which, when the concentration unevenness information acquisition device acquires the concentration unevenness information representing that the concentration unevenness is visible, adjusts relative positions between the inkjet head and the image formed by the inkjet head to make a distance from a boundary position of the inkjet head in the first direction corresponding to a position of the concentration boundary in the first direction to a second concentration region end of the inkjet head in the first direction be less than a reciprocal of a spatial frequency of the concentration unevenness.

2. The image forming apparatus according to claim 1, wherein the adjustment device adjusts a correspondence relationship between the nozzles and dots forming an image in the first direction.

3. The image forming apparatus according to claim 1, wherein the adjustment device moves a conveyance path of the inkjet head or a medium on which an image is formed along the first direction.

4. The image forming apparatus according to claim 1, wherein the concentration unevenness information acquisition device acquires the concentration unevenness information generated using an evaluation function which defines a relationship between a value acquired by subtracting a print rate in the second concentration region from a print rate represented by an area covered by ink in each unit area in the first concentration region or a value acquired by dividing a print rate in the first concentration region by the print rate in the second concentration region and visibility of concentration unevenness.

5. The image forming apparatus according to claim 1, wherein if a concentration at the concentration boundary changes continuously or stepwise in the first direction, the concentration unevenness information acquisition device acquires the concentration unevenness information generated using a representative position of the concentration boundary, and the adjustment device performs a process while regarding a position in the first direction corresponding to the representative position as the boundary position.

6. The image forming apparatus according to claim 1, wherein when the concentration unevenness information acquisition device acquires the concentration unevenness information that the concentration unevenness is visible at a plurality of positions in an image, the adjustment device selects a most visible piece of concentration unevenness from among the pieces of concentration unevenness, and performs a process at a position of the image where the selected piece of concentration unevenness occurs.

7. The image forming apparatus according to claim 1, wherein the inkjet head includes at least an inkjet head for black ink, the concentration unevenness information acquisition device acquires the concentration unevenness information in a region formed using the black ink, and in conformity with the adjustment related to the inkjet head for the black ink, the adjustment device performs adjustment related to an inkjet head for ink of another color.

8. The image forming apparatus according to claim 1, further comprising a head unit which has a structure where a plurality of the inkjet heads are coupled together along the first direction.

* * * * *